US012679597B2

(12) United States Patent
Sterling

(10) Patent No.: US 12,679,597 B2
(45) Date of Patent: Jul. 14, 2026

(54) CRATE WITH ADJUSTMENT MECHANISM

(71) Applicant: Patry Sterling, Chicago Ridge, IL (US)

(72) Inventor: Patry Sterling, Chicago Ridge, IL (US)

( * ) Notice: Subject to any disclaimer, the term of this patent is extended or adjusted under 35 U.S.C. 154(b) by 2 days.

(21) Appl. No.: 18/662,559

(22) Filed: May 13, 2024

(65) Prior Publication Data

US 2024/0375822 A1 Nov. 14, 2024

Related U.S. Application Data

(60) Provisional application No. 63/501,803, filed on May 12, 2023.

(51) Int. Cl.
*B65D 25/06* (2006.01)
*B65D 1/22* (2006.01)
*B65D 25/10* (2006.01)

(52) U.S. Cl.
CPC ..... *B65D 25/06* (2013.01); *B65D 1/22* (2013.01); *B65D 25/10* (2013.01)

(58) Field of Classification Search
CPC .... B65D 25/06; B65D 25/24; B65D 25/2867; B65D 19/40; A47G 23/0641
USPC ..... 220/531; 206/561, 45.24, 577, 600; 248/454, 456, 463, 457, 455, 127, 370
See application file for complete search history.

(56) References Cited

U.S. PATENT DOCUMENTS 1,552,856 A * 9/1925 Judge ..... B65D 21/086 294/142
4,505,408 A * 3/1985 Sagol ..... B65D 90/14 108/127
5,036,979 A * 8/1991 Selz ..... B65D 19/20 206/386
7,290,663 B2 * 11/2007 Deng ..... B65D 11/1826 206/600
8,360,382 B2 * 1/2013 Wu ..... F16M 13/00 248/688
2011/0168729 A1 * 7/2011 Koenig ..... B65D 25/2858 220/768
2017/0172330 A1 * 6/2017 Cameron ..... B65D 25/24
2024/0200861 A1 * 6/2024 Woodling ..... F25D 25/022

OTHER PUBLICATIONS

Greenmade InstaCrate, Product Information, https://www.acehardware.com/departments/storage-and-organization/totes-bins-and-baskets/household-storage-bins-boxes-drawers/5038311?store=17391&gad_source=1&gclid=EAIaIQobChMIh7q-mMXjhwMV9jllBR1U4x8NEAQYASABEgLMufD_BwE&gclsrc=aw.ds, 2024, 2 pages.
Stupid Car Tray, Product Information, https://www.amazon.com/Stupid-Car-Tray-Passenger-Organizer/dp/B083G7CTZY?th=1, 2024, 6 pages.

* cited by examiner

*Primary Examiner* — Rafael A Ortiz
(74) *Attorney, Agent, or Firm* — Quarles & Brady LLP

(57) ABSTRACT

A crate can include a base panel that defines a bottom surface of the crate and a plurality of side panels extending upwardly from the base panel to define an interior cavity of the crate. The crate can further include an adjustable leg that can be moveably coupled to the base panel. The adjustable leg can be configured to move relative to the base panel between a stored configuration, wherein the adjustable leg is substantially parallel with the base panel, and an extended configuration, where the adjustable leg extends away from the plurality of side panels.

18 Claims, 16 Drawing Sheets

CRATE WITH ADJUSTMENT MECHANISM

CROSS REFERENCE TO RELATED APPLICATIONS

This application claims the benefit of U.S. Provisional Patent Application No. 63/501,803, filed on May 12, 2023, which is incorporated herein by reference in its entirety.

BACKGROUND

Crates can be used for a variety of purposes, including for transporting goods from one location to another. In some cases, a crate may be particularly adapted to transport a specific category of goods, for example, transporting various food items for a food delivery service.

SUMMARY

Embodiments of the invention can provide an improved crate, including a collapsible crate configured for use as a food delivery crate. The crate can include an adjustable leg that can be manipulated by a user to allow the crate to maintain an upright or horizontal orientation when placed on both horizontal surfaces and sloped surfaces.

In one aspect a crate is provided. The crate can include a base panel, a plurality of side panels, and an adjustable leg. The base panel can define a bottom surface of the crate and the plurality of side panels can extend upwardly from the base panel to define an interior cavity of the crate. The adjustable leg can be moveably coupled to the base panel and can be configured to rotate relative to the base panel between a stored configuration, in which the adjustable leg is substantially parallel with the base panel, and an extended configuration, in which the adjustable leg extends away from the plurality of side panels.

In some aspects, the adjustable leg can include a first leg pin opposite a second leg pin. Each of the first leg pin and the second leg pin can be configured to be received within respective first and second pivot slots defined in the base panel. Each of the first and second pivot slots can define a first pivot section and a second pivot section that are separated from one another by a pair of opposing projections. In that regard, the adjustable leg can be configured so that each of the first leg pin and the second leg pin are rotatably received in each of the first pivot section and the second pivot section of the respective first and second pivot slots, and to be snappably moveable between the first pivot section and the second pivot section of the respective first and second pivot slots. Thus, in the stored configuration, the first leg pin can be received in the first pivot section of the first pivot slot and the second leg pin can be received in the first pivot section of the second pivot slot, and in the extended configuration, the first leg pin can be received in the second pivot section of the first pivot slot and the second leg pin can be received in the second pivot section of the second pivot slot.

In some aspects, the base panel can define a bottom recess that can be configured to receive the adjustable leg. In particular, the adjustable leg can be fully received within the bottom recess in the stored configuration and can extending out of and away from the bottom recess in the extended configuration. Additionally, the bottom recess can include a locking lip that can be configured to retain the adjustable leg in the stored configuration.

In some aspects, the adjustable leg can be configured to rotate relative to the base panel to extend away from the base panel in the extended configuration. In particular, the adjustable leg can be configured to extend at a non-zero angle relative to a bottom surface of the base panel in the extended configuration. In some cases, the adjustable leg can be configured to extend at one or more discrete angles relative to the bottom surface of the base panel. Accordingly, the adjustable leg can be configured to raise a first end of the crate so that the base panel is horizontal when the crate is placed on a sloped support surface.

In some aspects, the crate can further include a top ring and the plurality of side panels includes a first side panel opposite a second side panel and a first end panel opposite a second end panel. The first side panel can include a first sub-panel rotatably coupled to a second sub-panel. The first sub-panel can further be rotatably coupled to the base panel and the second sub-panel can further be rotatably coupled to the top ring. Similarly, the second side panel can include a third sub-panel rotatably coupled to a fourth sub-panel. The third sub-panel can further be rotatably coupled to the base panel and the fourth sub-panel can further be rotatably coupled to the top ring. Additionally, the first end panel can be rotatably coupled to the top ring and can be configured to selectively engage with the base. Likewise, the second end panel can be rotatably coupled to the top ring and can be configured to selectively engage with the base.

In another aspect, a crate is provided. The crate can include a base panel defining a bottom surface of the crate, a top ring disposed above the base panel, a first side panel, a second side panel, a first end panel, a second end panel, and an adjustable leg. The first side panel can include a first sub-panel rotatably coupled to a second sub-panel. The first sub-panel can further be rotatably coupled to the base panel and the second sub-panel can further be rotatably coupled to the top ring. Similarly, the second side panel can include a third sub-panel rotatably coupled to a fourth sub-panel. The third sub-panel can further be rotatably coupled to the base panel and the fourth sub-panel can further be rotatably coupled to the top ring. Additionally, the first end panel can be rotatably coupled to the top ring and can be configured to selectively engage with the base. Likewise, the second end panel can be rotatably coupled to the top ring and can be configured to selectively engage with the base. The adjustable leg can be moveably coupled to the base panel. In particular, the adjustable leg can be configured to rotate relative to the base panel between a stored configuration, in which the adjustable leg is substantially parallel with the base panel, and an extended configuration, in which the adjustable leg extends away from the base panel at a non-zero angle relative to the bottom surface.

In some aspects, the base panel can define a bottom recess that is open along the bottom surface. The bottom recess can be configured to fully receive the adjustable leg in the stored configuration and to allow the adjustable leg to rotate relative to the base panel to extend out of the bottom recess in the extended configuration. In that regard, the adjustable leg can include a first leg pin extending outwardly from a side of the adjustable leg and a second leg pin extending outwardly from an opposing side of the adjustable leg. The first leg pin can be configured to be received within a first pivot slot defined within the bottom recess. The second leg pin can be configured to be received within a second pivot slot defined within the bottom recess.

In some aspects, each of the first pivot slot and the second pivot slot can include a pair of opposing projections that extend into the respective pivot slot to define a first pivot section and a second pivot section. In the stored configuration, the first leg pin can be received in the first pivot section of the first pivot slot and the second leg pin can be received in the first pivot section of the second pivot slot. In the extended configuration, the first leg pin can be received in the second pivot section of the first pivot slot and the second leg pin can be received in the second pivot section of the second pivot slot. Accordingly, the opposing projections of the first pivot slot can be configured to selectively retain the first leg pin in each of the first and second pivot sections such that the first leg pin is snappably moveable between the first pivot section and the second pivot section of the first pivot slot. Likewise, the opposing projections of the second pivot slot can be configured to selectively retain the second leg pin in each of the first and second pivot sections such that the second leg pin is snappably moveable between the first pivot section and the second pivot section of the second pivot slot.

In some aspects, the non-zero angle between the adjustable leg and the bottom surface can be selectable by a user.

In another aspect, a base panel for a crate having a plurality of side panels extending upwardly from the base panel is provided. The base panel can include a bottom recess that opens along a bottom surface, which can be configured to contact a support surface, and an adjustable leg that can be moveably coupled to the base panel within the bottom recess. The adjustable leg can be configured to move relative to the base panel between a stored configuration, in which the adjustable leg is fully received within the bottom recess, and an extended configuration, in which the adjustable leg extends out of the bottom recess.

In some aspects, the movement of the adjustable leg between the stored configuration and the extended configuration can include one or both of rotational motion and translational motion relative to the base panel. In the stored configuration, the base panel can be horizontal when placed on a horizontal support surface. In the extended configuration, the adjustable leg can raise an end of the base panel so that the base panel is horizontal when placed on a sloped support surface.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
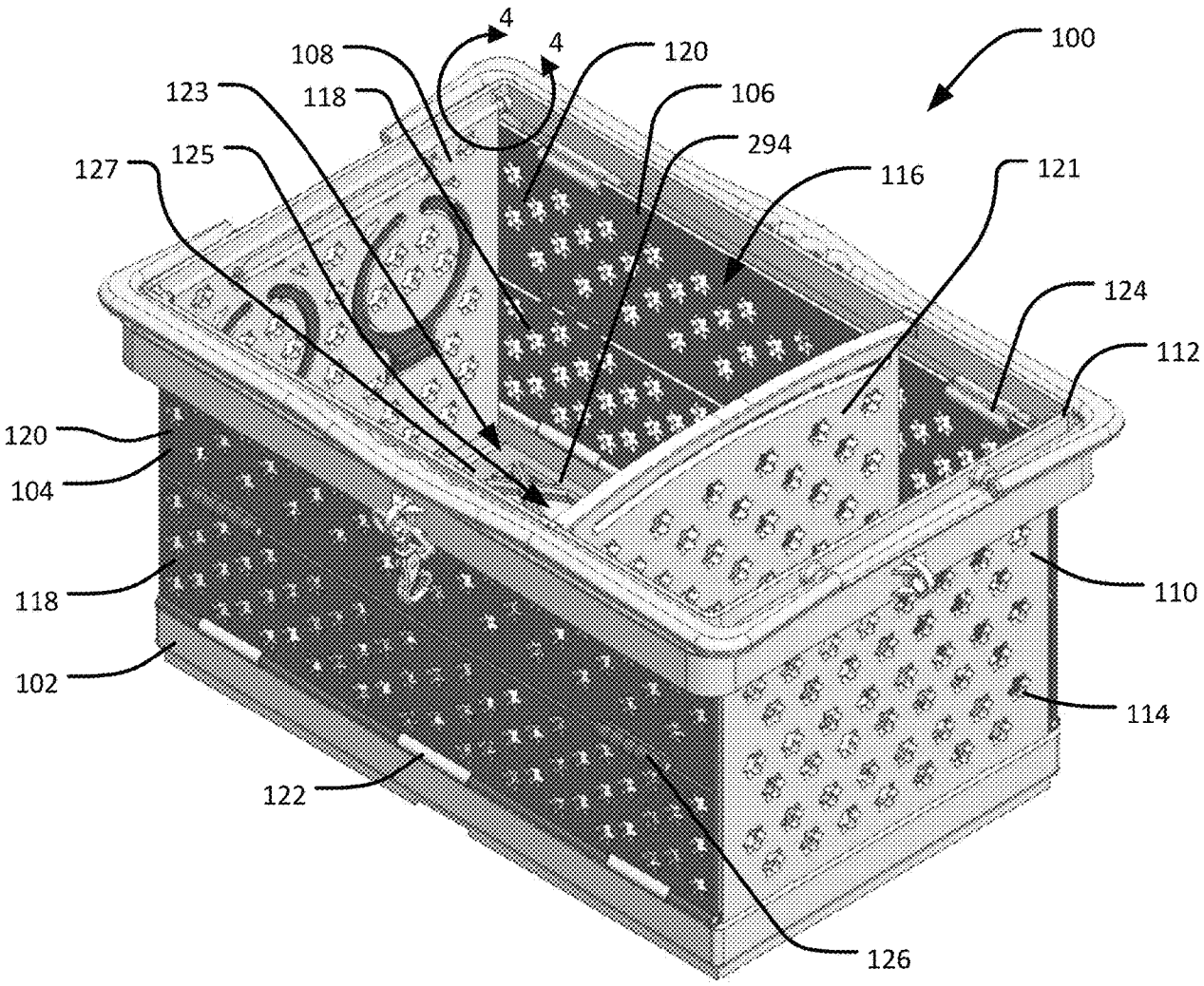
FIG. 1 is a top, front, and left isometric view of a crate according to aspects of the invention, which is configured as a collapsible food delivery crate in an un-collapsed configuration.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise specified or limited, "at least one of A, B, and C," and the like, is meant to indicate A, or B, or C, or any combination of A, B, and/or C. As such, these and similar phrases can include single or multiple instances of A, B, and/or C, and, in the case that any of A, B, and/or C indicates a category of elements, single or multiple instances of any of the elements of the category (or categories).

The term "about," as used herein, refers to variations in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes, unless indicated otherwise.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As noted above, crates can be used for a variety of purposes and may be specially adapted for delivery or storage of a specific type or category of goods. In particular, a crate may be specially adapted for the food delivery service industry in that it may be configured to allow for the safe and secure transport of a variety of take-out food items.

In recent years, the food delivery market has seen widespread growth, a large portion of which has been from platform-to-consumer services such as GrubHub®, DoorDash®, EatStreet®, and Uber Eats®. Such platform-to-consumer services generally rely on independent drivers, who are ultimately responsible for picking up an order from a restaurant and delivering it to the customer. These drivers typically use their own vehicles and many must provide their own equipment as necessary to perform the delivery. For example, some drivers may utilize tote bags, insulated delivery bags, and/or coolers to help keep food hot/cold and to prevent the food from spilling or becoming damaged during transport.

However, much of the equipment available to these drivers may not be capable of withstanding the rigors of heavy daily use and may not be able to reliably keep food items from spilling or otherwise becoming damaged in traffic. Relatedly, because drivers are generally paid per delivery, the equipment they use must allow them to be efficient during both pick-up and drop-off of an order.

For example, a known tray has a fixed leg that allows a top surface of the tray to be horizontal when placed upon a sloped surface, for example, the passenger seat of the car. While such trays can provide for a horizontal surface on which to place an order in some cases, the fixed nature of the leg does not allow the tray to maintain a horizontal surface in all scenarios due to the variability in seat angle. For example, the tray cannot be used to support items when placed on a horizontal support surface, as the leg will cause one end of the tray to be higher than the opposing side, increasing the likelihood that an object will slide or otherwise fall off the tray. Thus, while such trays may be adapted for use in a car, their usefulness outside of that specific context quickly diminishes. Accordingly, in a delivery scenario, a user must transfer food items to and from the tray when picking up or dropping off said food items, which can increase the time it takes to complete the delivery and may require the user to acquire additional equipment to make transport to and from the vehicle easier.

Embodiments of the present disclosure can provide for a lightweight yet rugged crate that can keep food items secure during the delivery process and that can provide for increased efficiency during both pick-up and drop-off. For example, some embodiments can provide a collapsible crate having an adjustable leg. The adjustable leg can be rotatably coupled within a recess formed in a base panel of the crate and can be moved (e.g., rotated and/or translated) relative to the crate between a stored configuration and an extended configuration. In the stored configuration, the adjustable leg can be fully retained within the recess so that it does not extend beyond a bottom surface of the crate, thereby allowing the crate to be in an upright (i.e., horizontal) orientation when placed onto a horizontal support surface, such as a counter or table, as may occur during pick-up and drop-off of an order. In the extended configuration, the adjustable leg can be rotated relative to the crate so that it extends beyond the bottom surface of the crate. In this way, the adjustable leg can allow the crate to remain upright (i.e., horizontal) when set on an angled (i.e., sloped or slanted) surface, for example, a seat of a vehicle. Accordingly, the adjustable leg allows the crate to be placed in an upright or horizontal position on both flat and angled surfaces.

Additionally, a crate may include a number of features that are specially adapted for carrying and securely holding food items during transport. For example, a crate may include a grate that can be placed along a bottom of a crate, which raises the food items off the bottom of the crate and can help prevent damage to other food items in the case of a spill. Additionally, a crate may include an adjustable divider that can be used to divide or separate multiple orders being carried in the same crate. Furthermore, a crate may include storable cup holders that can be used to transport drinks and help prevent them from tipping over during transport. Moreover, a crate may include various attachment features on the outside of the crate to allow food items to be attached to or hung from the crate, thereby increasing the overall carrying capacity.

Figure 2:
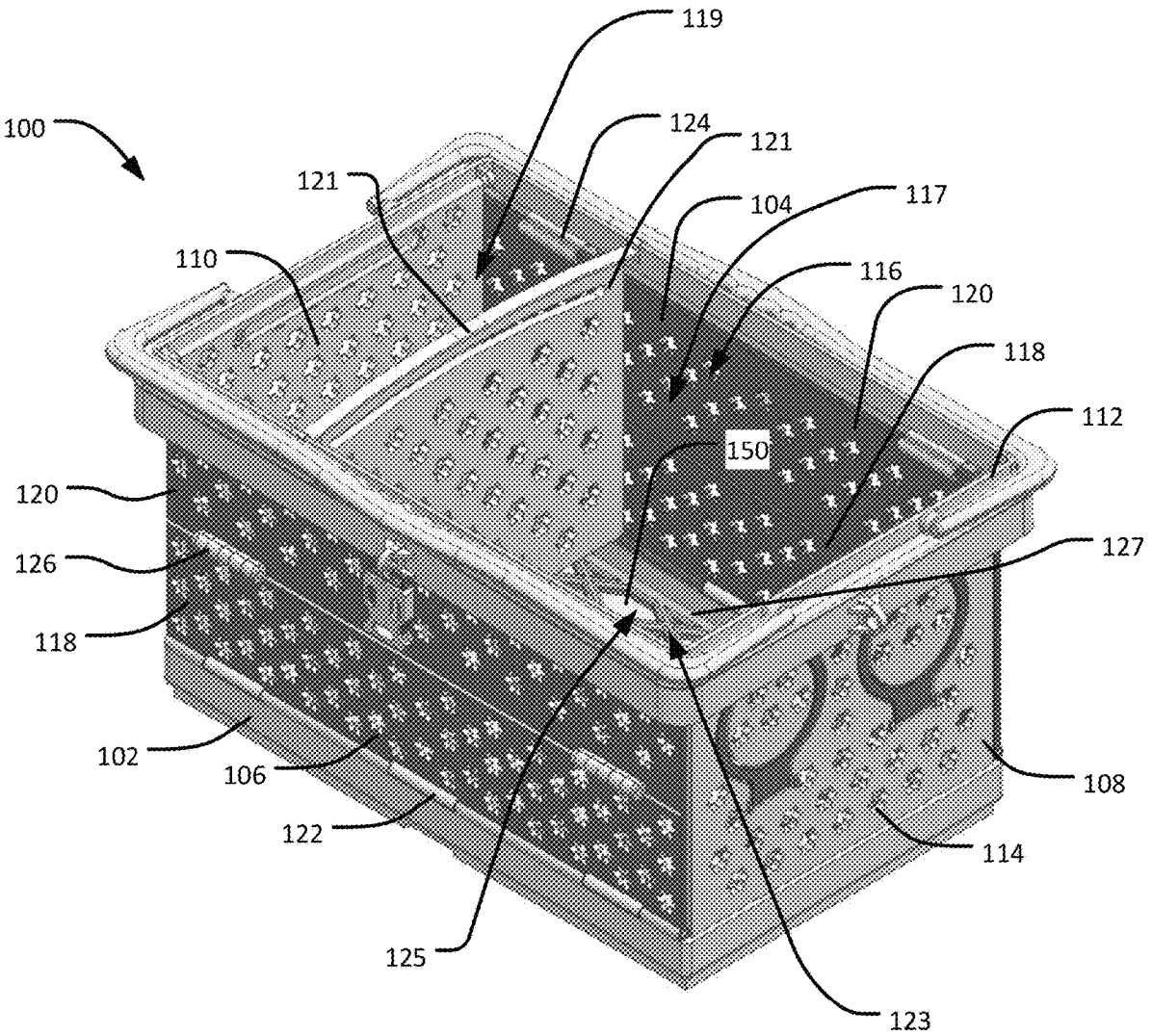
FIG. 2 is a top, back, and right isometric view of the crate of FIG. 1.
Figure 3:
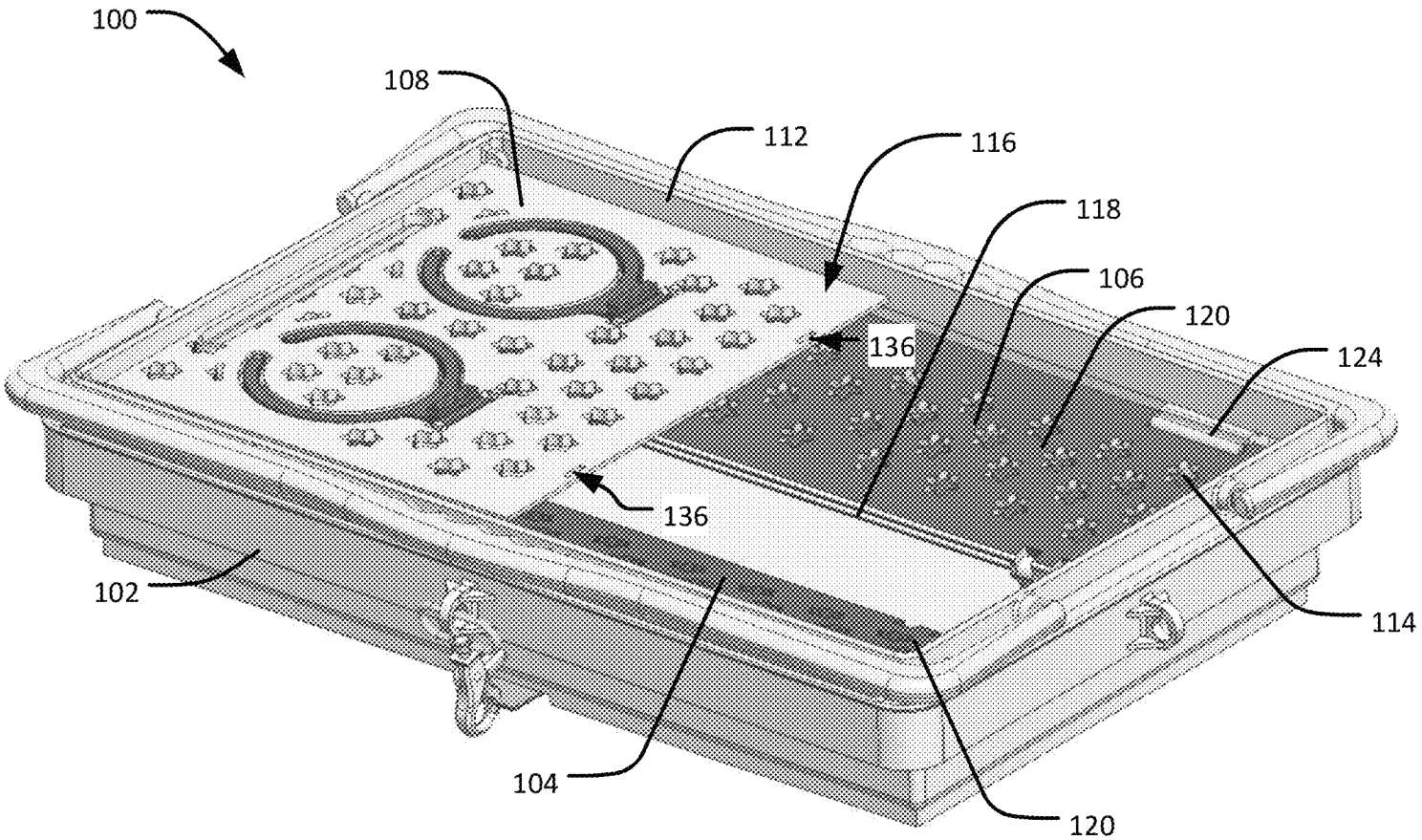
FIG. 3 is a top, front, and left isometric view of the crate of FIG. 1 in a collapsed configuration with an end panel removed.

FIGS. 1-3 depict an example embodiment of a crate 100 on which aspects of the disclosure may be practiced. As illustrated, the crate 100 is a collapsible crate that is configured for use in delivering food. More specifically, the crate 100 can be articulated by a user to place the crate in either an un-collapsed configuration where food items can be securely retained within or on top of the crate 100 or a collapsed configuration where food items cannot be placed within the crate 100, but can still be secured on top of the crate 100. For example, it may be preferable to collapse the crate 100 when transporting items on top of the crate 100, thereby lowering the center of gravity and reducing the possibility of spilling or tipping. However, aspects of this disclosure may be equally applicable to non-collapsible or rigid crates. Additionally, while the crate 100 is shown having a cuboid shape, other configurations and shapes are possible.

With continued reference to FIGS. 1-3, the crate 100 may include a base panel 102, a first side panel 104 opposite a second side panel 106, a first end panel 108 opposite a second end panel 110, and a top ring 112, which together form a main body of the crate 100. Each of the first side panel 104, the second side panel 106, the first end panel 108, the second end panel 110 are shown as substantially flat panels including a plurality of holes or perforations 114. The perforations 114 can serve as a decorative element that lends to the visual appeal of the crate 100, while also reducing the weight of the crate 100 to allow for easier carrying by a driver. In that regard, other shapes and configurations of perforations are possible. However, the perforations 114 are not necessary and may not be included in other embodiments. Furthermore, the panels may not always be flat and may include, for example, various bumps and/or contours.

Together, the base panel 102, the first side panel 104, the second side panel 106, the first end panel 108, the second end panel 110, and the top ring 112 define an interior cavity 116 of the crate 100. More specifically, the first side panel 104, the second side panel 106, the first end panel 108, the second end panel 110 are each coupled to and extend between the base panel 102 and the top ring 112, thereby forming the sides of the crate 100, which surround the interior cavity 116. The interior cavity 116 can be configured to receive and secure food items during delivery. Thus, the crate 100 can retain food or other items within the interior cavity 116 to reduce the possibility of spills or other damage. As such, the crate 100 can be used to transport food items from a restaurant to a delivery vehicle and from the delivery vehicle to a customer, in addition to holding the food items during transport between a restaurant and a customer.

Each of the first side panel 104 and the second side panel 106 are side walls of the crate 100 and include a bottom or first sub-panel 118 and a top or second sub-panel 120. The first sub-panel 118 is rotatably coupled to the base panel 102 by a bottom or first hinge 122 and the second sub-panel 120 is rotatably coupled to the top ring 112 by a top or second hinge 124. Additionally, the first sub-panel 118 and the second sub-panel 120 are rotatably coupled to one another by intermediate or third hinge 126. It is appreciated that each of the first hinge 122, the second hinge 124, and the third hinge 126 may include one or multiple hinges. For example, as illustrated, the first hinge 122 includes a single hinge while the second hinge 124 and the third hinge 126 are each comprised of two hinges that are spaced apart. Additionally, each of the first hinge 122, the second hinge 124, and the third hinge 126 may be partially or entirely integral with the respective base panel 102, top ring 112, first sub-panel 118, and second sub-panel 120, or they may be separate structures that are coupled to the respective panels. As illustrated, the first hinge 122 and the third hinge 126 are configured as butt hinges and the second hinge 124 is configured as a snap-fit hinge. However, other types of hinge structures as known in the art may also be used.

Each of the first hinge 122, the second hinge 124, and the third hinge 126 are configured to work together to limit and/or control the relative rotation between the first sub-panel 118 and the second sub-panel 120. More specifically, the first hinge 122 allows the first sub-panel 118 to rotate relative to the base panel 102, the second hinge 124 allows the second sub-panel 120 to rotate relative to the top ring 112, and the third hinge 126 allows the first sub-panel 118 and the second sub-panel 120 to rotate relative to one another. Taken together, the hinges 122-126 allow the first sub panel 118 and the second sub-panel 120 to rotate inward (i.e., into) toward the interior cavity 116 of the crate 100 from an un-collapsed configuration, where the first sub-panel 118 and the second sub-panel 120 are coplanar with one another (see FIGS. 1 and 2), to a collapsed configuration, where the first sub-panel 118 and the second sub-panel 120 are angled (i.e., not coplanar) to one another (see FIG. 3), while simultaneously moving the top ring 112 downward toward the base panel 102.

Still referring to FIGS. 1-3, each of the first end panel 108 and the second end panel 110 are rotatably coupled to the top ring 112. In particular, each of the first and second end panels 108, 110 can independently rotate between an un-collapsed configuration where each of the respective end panels 108, 110 are rotated downward to engage (e.g., by a snap fit engagement) with the base panel 102 and lock the crate 100 in the un-collapsed configuration (see FIGS. 1 and 2), and a collapsed configuration where the end panels 108, 110 are rotated upward into the interior cavity 116 to allow the crate 100 to be collapsed (see FIG. 3).

Still referring to FIGS. 1-3, the crate 100 may also include an adjustable divider 121 disposed within an interior cavity to separate the interior cavity into discrete sections. In particular, the crate 100 includes an adjustable divider 121 configured as a panel that slidably engages with the top ring 112 of the crate 100. More specifically, the adjustable divider 121 can slide relative to the top ring 112 between the first end panel 108 and the second end panel 110. In this way, the adjustable divider 121 can separate the interior cavity 116 into a first interior cavity portion 117 and a second interior cavity portion 119. Because the adjustable divider 121 can be slid along the top ring 112, the relative sizes of the first interior cavity portion 117 and the second interior cavity portion 119 can be adjusted as needed. Additionally, the adjustable divider 121 can be removable so that it can be stored within the interior cavity 116 (i.e., placed on the base surface 150) when not in use or when the crate 100 is to be placed in the collapsed configuration.

Still referring to FIGS. 1-3, the crate 100 can further include a bottom panel or grate 123 configured to be placed on the base surface 150. As illustrated, the grate 123 can be configured as a removable grate that is correspondingly shaped to be supported within the interior cavity 116 by the base surface 150. In turn, food items can then be placed on and supported by the grate 123. The grate 123 can include perforations or openings 125, which, for example, can allow a spilled liquid to flow into openings 125 and/or beneath the grate 123, thereby keeping the liquids from contacting and potentially damaging or contaminating any other food items being held within the interior cavity 116.

Figure 4:
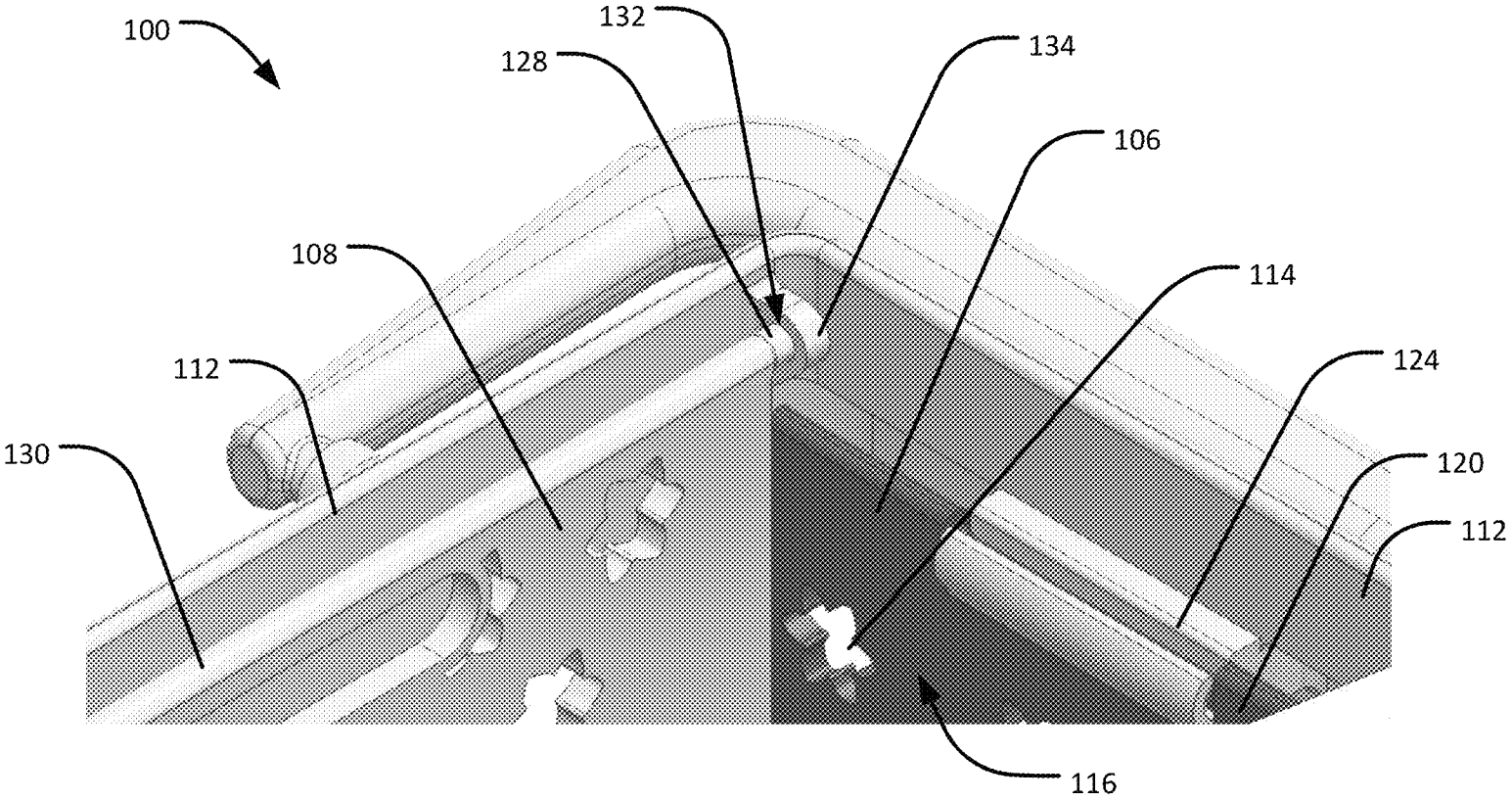
FIG. 4 is a partial perspective view of the crate of FIG. 1, taken about the line 4-4.

With additional reference to FIG. 4, to facilitate the independent rotation of each of end panels 108, 110 relative to the top ring 112, each end panel 108, 110 includes panel pins 128 that extend outward toward the respective first side panel 104 and second side panel 106. The panel pins 128 are configured as cylindrical pins that extend outwardly (e.g., towards the side panels 104, 106) from opposing edges of each of the respective end panels 108, 110 and proximate a respective top edge 130. Each panel pin 128 can be rotatably received in a corresponding annular hole 132 of top ring 112 to allow the end panels 108, 110 to rotate relative to the top ring 112. That is, the panel pins 128 can be received within the annular holes 132 to form a hinge that allows each end panel 108, 110 to rotate relative to the rest of the crate 100. Here, each annular hole 132 is formed in a corresponding pivot bracket 134 that is integrally formed with the top ring 112 and that extends inwardly toward the interior cavity 116 of the crate 100. In other embodiments, the annular holes 132 may not be provided in a bracket, or a bracket may be provided as a separate structure that couples with the top ring 112. Additionally, other configurations of hinges as known in the art may alternatively or additionally be used to rotatably couple the end panels 108, 110 with the top ring 112.

Figure 5:
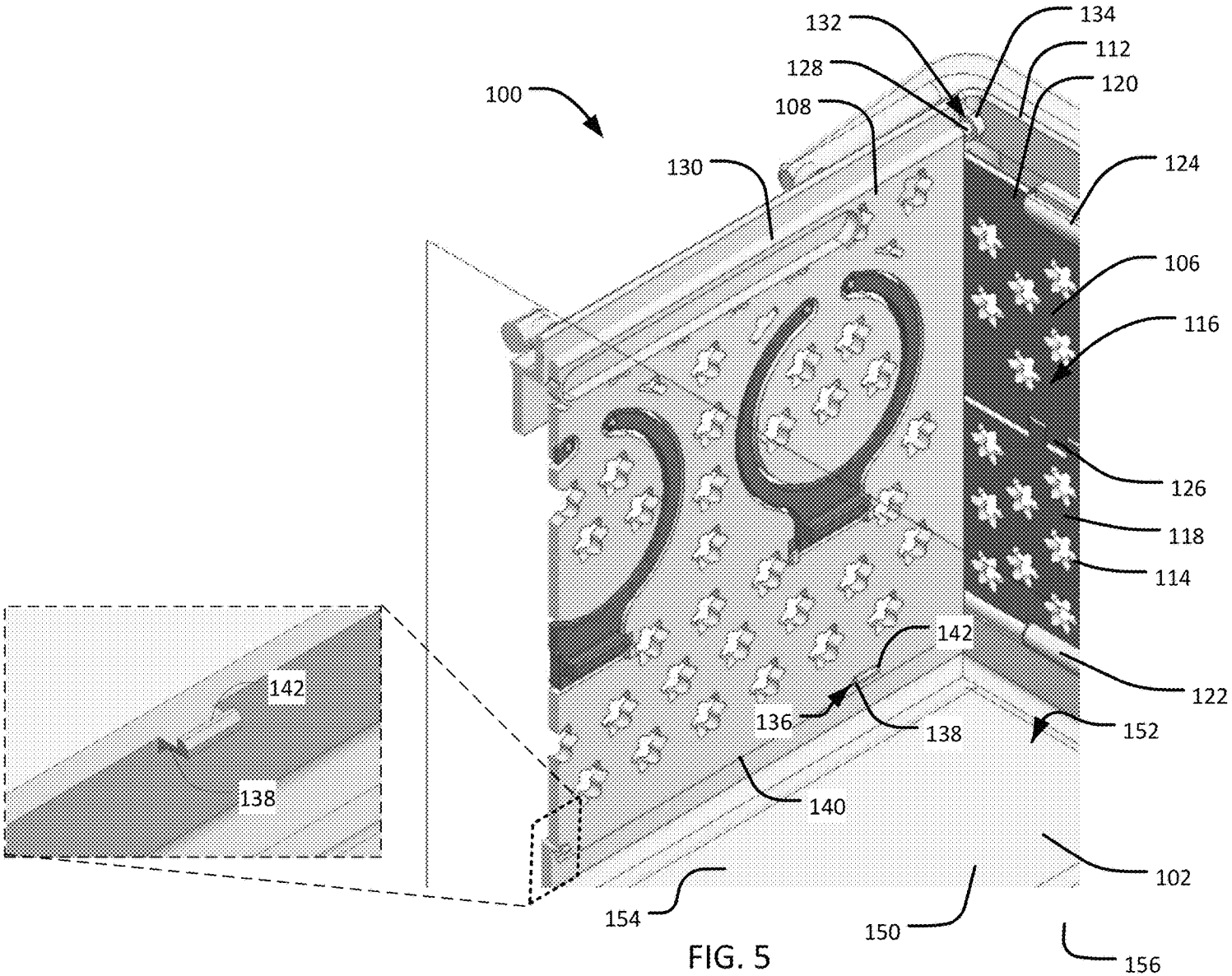
FIG. 5 is a partial section view of the crate of FIG. 1.

Additionally, to allow the end panels 108, 110 to engage with the base panel 102, each end panel 108, 110 can include one or more locking features to secure (i.e., retain) the end panels 108, 110 in the un-collapsed configuration. For example, with additional reference to FIG. 5, each end panel 108, 110 can include locking slits 136 that are configured to engage with and receive a corresponding locking tab 138 extending inwardly from the base panel 102 toward the interior cavity 116. More specifically, as illustrated, each end panel 108, 110 includes two spaced-apart locking slits 136 disposed along a bottom end 140 of each of the end panels 108, 110. Each locking slit 136 can be configured as a linear groove or slot that extends through and defines an opening in the end panels 108, 110. Each locking tab 138 includes a distal tooth or lip 142 that engages with the respective end panel 108, 110 in the un-collapsed configuration to create a cantilever-type snap-fit connection. That is, the distal lip 142 can extend through the corresponding locking slit 136 to engage with the respective end panel 108, 110, thereby locking the end panels 108, 110 in the un-collapsed configuration. In other embodiments, the end panels 108, 110 may include other locking features as known in the art to secure the end panels 108, 110 in the un-collapsed configuration.

In other embodiments, the end panels 108, 110 may be configured to rotate in the opposite manner. For example, panel pins 128 may instead be positioned to rotatably engage with the annular holes 132, which can be formed in the base panel 102. As a result, the end panels 108, 110 can move between an un-collapsed configuration where the end panels 108, 110 are rotated upward to engage with the top ring 112, and a collapsed configuration where the end panels 108, 110 are rotated downward into the interior cavity 116 to allow the crate 100 to be collapsed. Accordingly, the locking slits 136 may be configured to engage with the locking tabs 138, which can extend from the top ring 112, to retain the end panels 108, 110 in the un-collapsed configuration.

Referring still to FIGS. 1-3 to articulate the crate 100 from the un-collapsed configuration (see FIGS. 1-2) to the collapsed configuration (see FIG. 3), a user can disengage each end panel 108, 110 from the base panel 102 by disengaging the locking slits 136 from the locking tabs 138. With the locking slits 136 and locking tabs 138 disengaged, the end panels 108, 110 can be rotated upward from their un-collapsed configuration position to the collapsed configuration, such that the end panels 108, 110 are positioned within the interior cavity 116 and are substantially parallel (e.g., within 5 degrees of parallel) with the base panel 102. Put another way, the first end panel 108 can rotate upward and inward (e.g., into the interior cavity 116) to extend toward the second end panel 110 and the second end panel 110 can rotate upward and inward to extend toward the first end panel 108.

With the end panels 108, 110 rotated upward, the side panels 104, 106 can then be placed in their respective collapsed configuration, thereby placing the crate 100 in its collapsed configuration. More specifically, the first and second sub-panels 118, 120 can rotate in opposite directions about the first and second hinges 122 124, respectively, to move the third hinge 126 inward toward the interior cavity 116. Accordingly, the first sub-panel 118 and the second sub-panel 120 are rotated towards one another about the third hinge 126. Because the first and second sub-panels 118, 120 have a fixed width (e.g., a dimension taken along the direction going from the base panel 102 towards the top ring 112 in the un-collapsed configuration) and are rotatably connected at the third hinge 126, the top ring 112 is thereby simultaneously moved downward toward the base panel 102 until the side panels 104, 106 are in their collapsed configuration, wherein the first and second sub-panels 118, 120 are approximately parallel (e.g. within 5 degrees of parallel) with the base panel 102.

It is appreciated that, while the crate 100 is shown as being a collapsible crate where the base panel 102, the first side panel 104, the second side panel 106, the first end panel 108, the second end panel 110, and the top ring 112, are separate members, in other embodiments, the crate 100 may not be or may be only partially collapsible. That is, any or all of the base panel 102, the first side panel 104, the second side panel 106, the first end panel 108, the second end panel 110, and the top ring 112 may be fixedly connected (e.g., integrally formed) with one another. Furthermore, each of the various panels may include additional connections other than described herein. For example, a side panel may be coupled to an end panel. Moreover, depending on the specific connections used, a top ring may be omitted, for example, when a first side panel is connected to each of a first end panel and a second end panel, and a second side panel is also connected with each of the first end panel and the second end panel.

Figure 6:
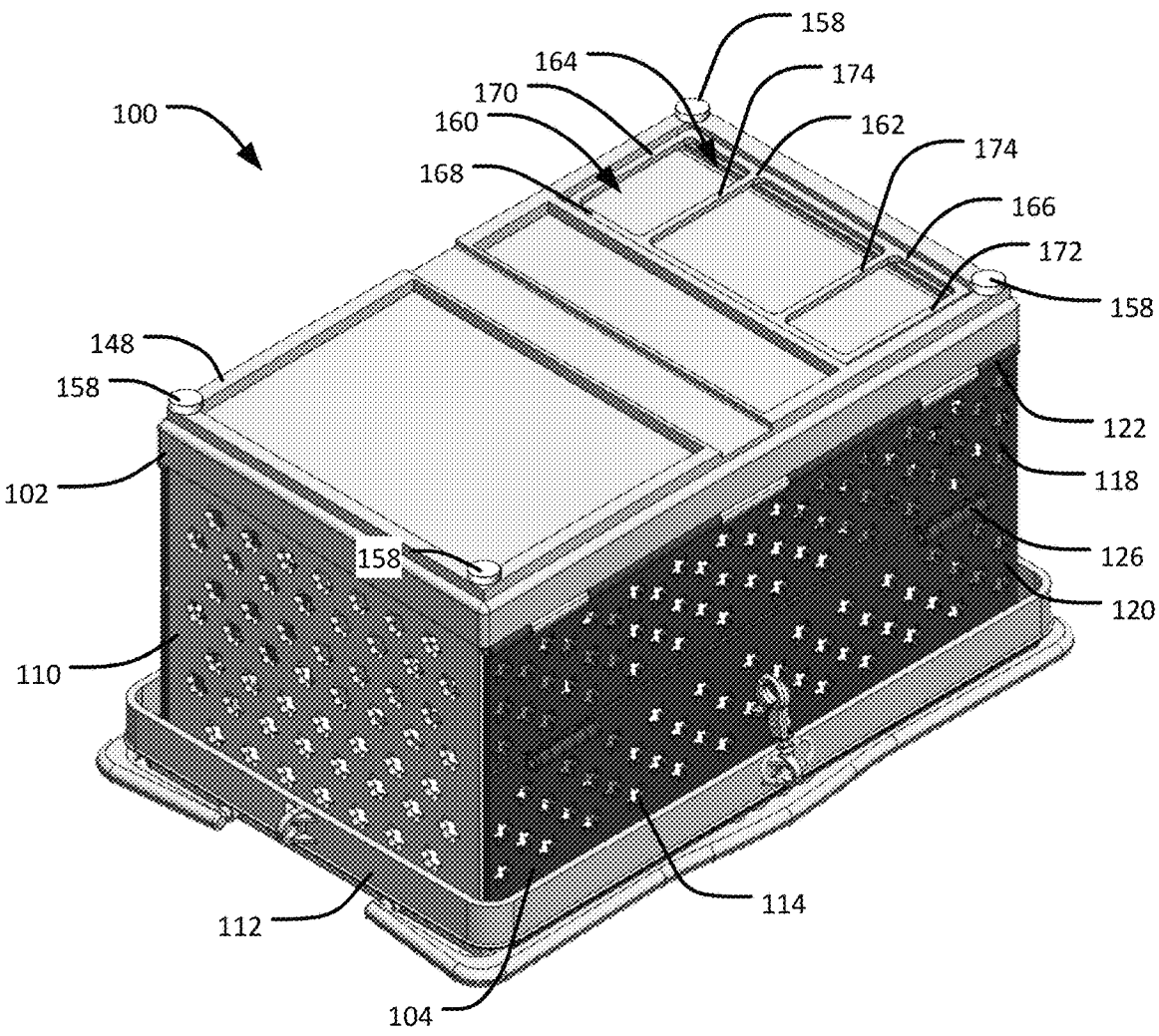
FIG. 6 is a bottom left perspective view of the crate of FIG. 1 with an adjustable support leg in a stored configuration.
Figure 7:
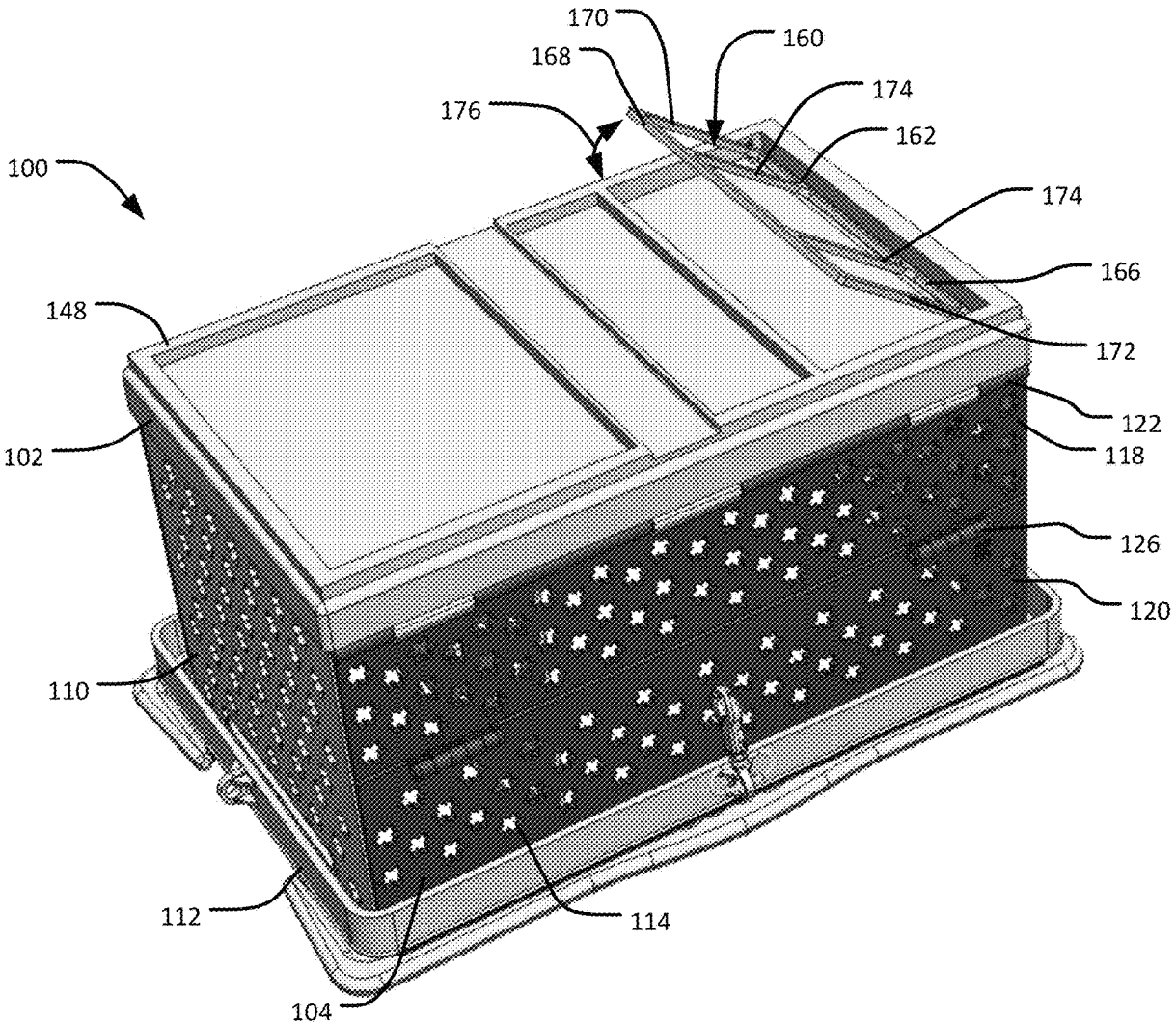
FIG. 7 is a bottom left perspective view of the crate of FIG. 1 with the adjustable support leg in an extended configuration.

Turning now to FIGS. 6 and 7, the base panel 102 can be a floor or bottom of the crate 100 and defines a bottom surface 148 that can be configured to contact a supporting surface (e.g., a seat of a vehicle or a countertop) on which the crate 100 may be placed. The base panel 102 can further define an interior or base surface 150 (see FIG. 5) opposite and parallel to the bottom surface 148, which defines a bottom of the interior cavity 116 and can be configured to receive and support food items. In some embodiments, the base surface 150 can be disposed at a bottom of a base recess 152 (see FIG. 5) formed in the base panel 102, which can form a portion of the interior cavity 116 of the crate 100. However, in other embodiments, a base recess 152 may not be present and the base surface 150 may be a top surface of the base panel 102.

Additionally, the base surface 150 may be comprised of one or more sub-surfaces, which may be disposed at different heights relative to one another. Here, the base surface 150 is comprised of a first or upper sub-surface 154 that is disposed higher (i.e., closer to the top ring 112) within the interior cavity 116 than a second or lower sub-surface 156. In other embodiments, the base surface 150 can include ridges, channels, bumps, or elevated portions, which may allow the crate 100 to be configured to carry a specific type of food item, to keep food items separate from one another, and/or to help prevent food items from spilling or otherwise becoming damaged.

In some embodiments, a crate can include a plurality of feet to provide the crate with increased stability, thereby allowing the crate to be placed on a variety of surfaces. For example, with continued reference to FIGS. 6 and 7, the base panel 102 can include a plurality of feet 158 attached to the bottom surface 148 of the base panel 102, which can be configured to contact a supporting surface. As illustrated, the feet 158 can be configured as rubber or rubber-like nubs, but can alternatively be any other type of feet as known in the art. Accordingly, the feet 158 can raise the base panel 102 above a support surface to accommodate any variations or unevenness (e.g., bumps, ridges, recesses, etc.) in the support surface. Additionally, because the feet 158 can be made from rubber or a rubber-like material, they can provide increased traction to reduce the possibility that the crate 100 inadvertently slides along the support surface. In other embodiments, other configurations of feet are possible. For example, feet may by integrally formed (i.e., co-molded) with a base panel or coupled to the base panel by a fastener or an adhesive, or there may be no feet at all. Relatedly, the feet 158 can also be made from other types of materials.

In some embodiments, a crate can be configured to allow the crate to be placed on both horizontal and sloped (i.e., angled) support surfaces, while maintaining the crate in an upright position (e.g., so that a base surface is horizontal). For example, with specific reference to FIGS. 6 and 7, the base panel 102 can further include a bottom recess 160 that can be configured to receive a support leg 162. The support leg 162 can be adjustable. That is, the bottom recess 160 may be shaped to receive the support leg 162. As illustrated, the bottom recess 160 has a rectangular shape that corresponds with the rectangular perimeter of the support leg 162; however, other shapes are possible. Additionally, the bottom recess 160 and the support leg 162 are positioned generally adjacent the second end panel 110. Put another way, the bottom recess 160 and the support leg 162 are disposed closer to the second end panel 110 than to the first end panel 108. In other embodiments, this may not always be the case and the bottom recess 160 and the support leg 162 may be disposed anywhere along the bottom surface 148 of the base panel 102.

Furthermore, as will be discussed in greater detail below, the bottom recess 160 can further include a secondary recess 164 formed in the bottom recess 160 to retain the support leg 162 in a desired position. As illustrated in the present embodiment, the secondary recess 164 can be configured as an elongate, linear recess that extends along a width of the crate 100 (e.g., a direction taken between the first side panel 104 and the second side panel 106). The secondary recess 164 can have a rectangular cross section and can be positioned closer to the second end panel 110 than to the first end panel 108, but this may not always be the case and the secondary recess 164 may be positioned elsewhere and/or oriented differently within the bottom recess 160. In other embodiments, the base panel 102 may alternatively or additionally include other types of retaining features as known the art, for example, projections or ridges.

With continued reference to FIGS. 6 and 7, the support leg 162 can be configured as a hollow rectangular member having a first side member 166 opposite a second side member 168, and a third side member 170 opposite a fourth side member 172. As illustrated, each of the third side member 170 and the fourth side member 172 extend between and join the first side member 166 with the second side member 168. Here, the respective side members are integrally formed but in other embodiments, they may also be individual members that can be coupled together. Additionally, each of the first side member 166, second side member 168, third side member 170, and fourth side member 172 can have a rectangular cross section, but differently shaped cross sections may also be used.

In some embodiments, a support leg can further include one or more braces or other similar structures to increase the strength and/or the rigidity of the support leg. As illustrated, the support leg 162 includes two braces 174 that are spaced apart and extend between the first side member 166 and the second side member 168. Each of the braces 174 can be configured as a linear, elongate member that is oriented parallel to the third side member 170 and/or the fourth side member 172. In other embodiments, there may be more or less braces and the braces may be curved. Furthermore, each of the braces 174 may alternatively or additionally extend between any of the sides 166-172 of the support leg 162 (e.g., similar to a truss).

A support leg can be configured to move relative to a base panel to allow a crate to remain upright (e.g., so that a base surface of a base panel is horizontal) on both horizontal and sloped surfaces. As mentioned above, the support leg 162 can be configured as an adjustable leg that can be manipulated by a user to place the base panel 102 (i.e., the base surface 150) in a horizontal orientation irrespective of whether a support surface is horizontal, angled, or otherwise sloped. More specifically, the support leg 162 can be rotatably coupled within the bottom recess 160 of the base panel 102 and can be rotated between a stored configuration (see FIG. 6) and an extended configuration (see FIG. 7).

In the stored configuration, the support leg 162 can be rotated so that the support leg 162 is disposed entirely within the bottom recess 160 and does not protrude beyond the bottom surface 148 of the base panel 102. For example, the support leg 162 can be parallel with the bottom surface 148 of the base panel 102, or the support leg 162 may be angled upward and into the recess to extend toward the base surface 150. Because the support leg 162 does not protrude beyond the bottom surface 148, the base surface 150 of the base panel 102 will be horizontal when the crate 100 is placed on a flat, horizontal surface.

In the extended configuration, the support leg 162 can be rotated so that at least a portion of the support leg 162 is positioned beyond (i.e., lower than) the bottom surface 148 of the base panel 102. That is, the support leg 162 can be rotated away from the base panel 102 by a non-zero angle 176 relative to the bottom surface 148 of the base panel 102 to extend out of the bottom recess 160 and beyond the bottom surface 148. In this way, the support leg 162 can elevate (i.e., raise) at least a portion of the crate 100 (e.g., and end of the crate 100) to position the base panel 102 in a horizontal orientation even when the crate 100 is placed on an angled or otherwise sloped surface (i.e., a non-horizontal surface).

Figure 8:
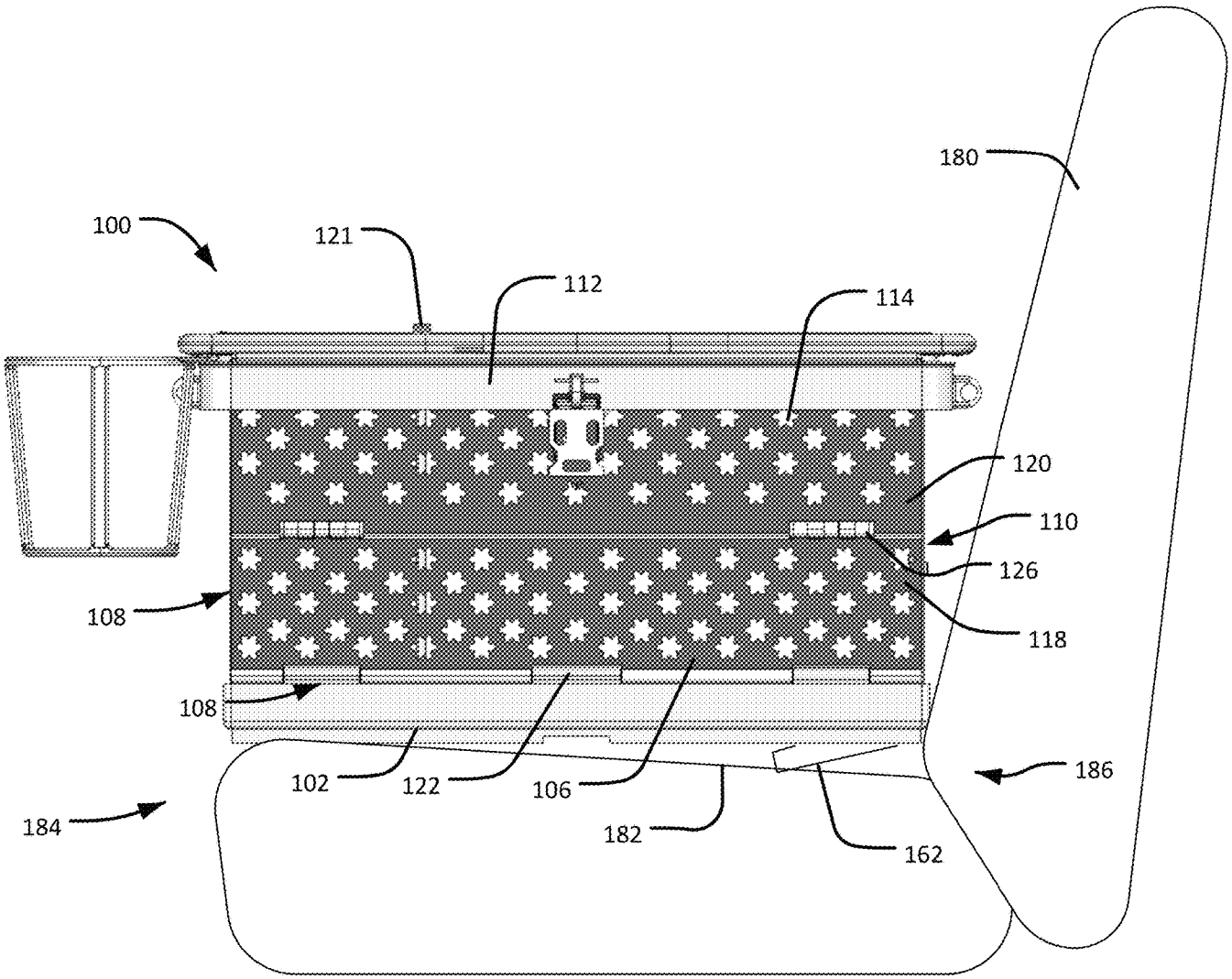
FIG. 8 is a right side plan view of the crate of FIG. 1 with the crate being supported by the adjustable support leg in an extended configuration on a seat of a vehicle.

For example, with specific reference to FIG. 8, the crate 100 is shown positioned on a seat 180 of a vehicle with the support leg 162 in an extended configuration. The seat 180 has an angled (i.e., sloped) seat surface 182 that is higher at a front end 184 of the seat surface 182 and lower at a back end 186 of the seat surface 182. The crate 100 is positioned on and supported by the seat surface 182 so that the first end panel 108 is adjacent the front end 184 of the seat surface 182 and the second end panel 110 is adjacent the back end 186 of the seat surface 182. At the front end 184 of the seat surface 182, the bottom surface 148 (e.g., the feet 158) of the base panel 102 contacts and is directly supported by the seat surface 182. At the back end 186 of the seat surface 182, the support leg 162 extends downwardly from base panel 102 to contact the seat surface 182 near the back end 186 of the seat surface 182. In this way, the support leg 162 extends between seat surface 182 and the bottom surface 148 of the base panel 102 to elevate and support the base panel 102 above the seat surface 182. In some cases, straps (e.g., a seat belt or separate straps) may be provided to secure the crate 100 to the seat 180.

Figure 9:
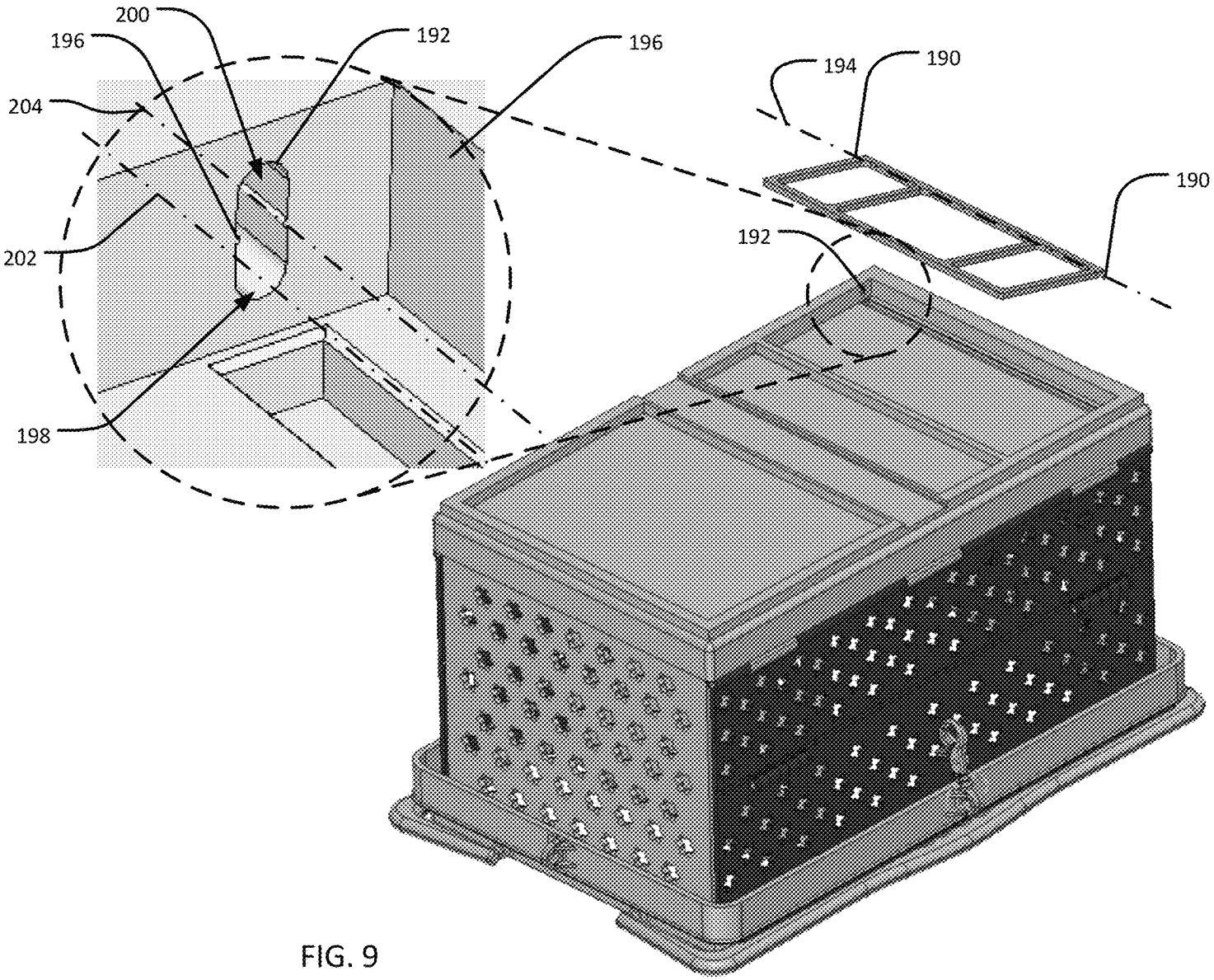
FIG. 9 is a partial exploded view of the crate of FIG. 1.

Turning to FIG. 9, to facilitate the rotation of support leg 162 relative to the bottom surface 148 of the base panel 102, the support leg includes a pair of leg pins 190 (i.e., first and second leg pins) that are each received by a corresponding pivot slot 192 (i.e., first and second pivot slots) formed in the base panel 102. The leg pins 190 are cylindrically shaped and extend outwardly (e.g., perpendicularly) from each of the third side member 170 and the fourth side member 172 of the support leg 162, so as to extend in opposite directions. The leg pins 190 are aligned (i.e., coaxial) with one another to define a support leg axis 194, which the support leg 162 rotates about to move between the stored configuration (see FIG. 6) and the extended configuration (see FIG. 7). As illustrated, the leg pins 190 are positioned adjacent the first side member 166 of the support leg 162 so that the support leg axis 194 extends along the first side member 166 of the support leg 162. However, in other embodiments, the leg pins 190 may be located anywhere along the third and fourth side members 170, 172.

Pivot slots can be configured to allow selective engagement of a support leg within the pivot slot, thereby allowing the support leg to move between a stored configuration and an extended configuration. For example, with continued reference to FIG. 9, each pivot slot 192 can be configured as a rounded, linear slot that includes opposing internal projections 196. The projections 196 can have a triangular shape and can extend inwardly towards one another to divide the pivot slot 192 into a first, lower or stored pivot section 198 and a second, upper or extended pivot section 200. Additionally, the projections 196 can be sized to selectively retain the leg pins 190 within each of the first pivot section 198 and the second pivot section 200.

Figure 10:
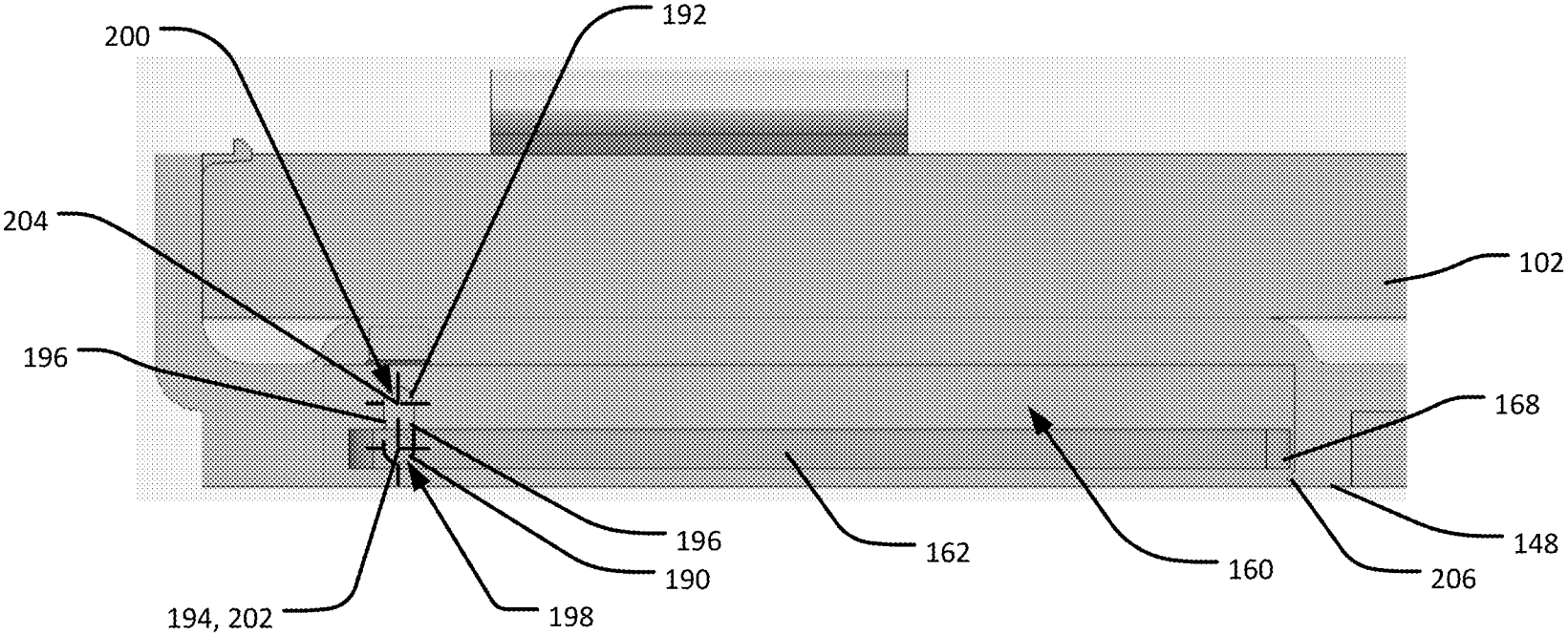
FIG. 10 is partial section view of the crate of FIG. 1 showing the adjustable support leg in the stored configuration.
Figure 11:
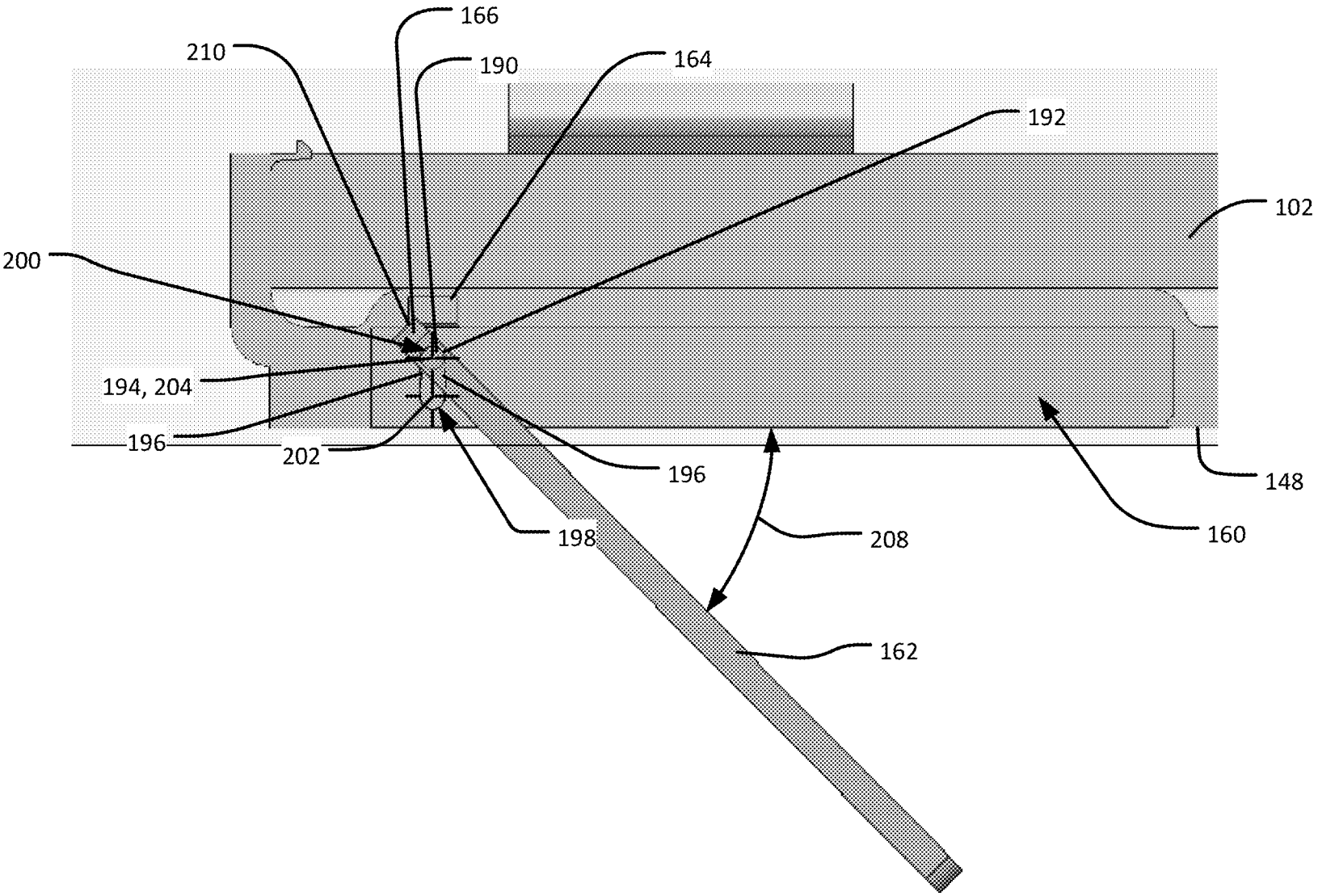
FIG. 11 is partial section view of the crate of FIG. 1 showing the adjustable support leg in a first extended configuration.
Figure 12:
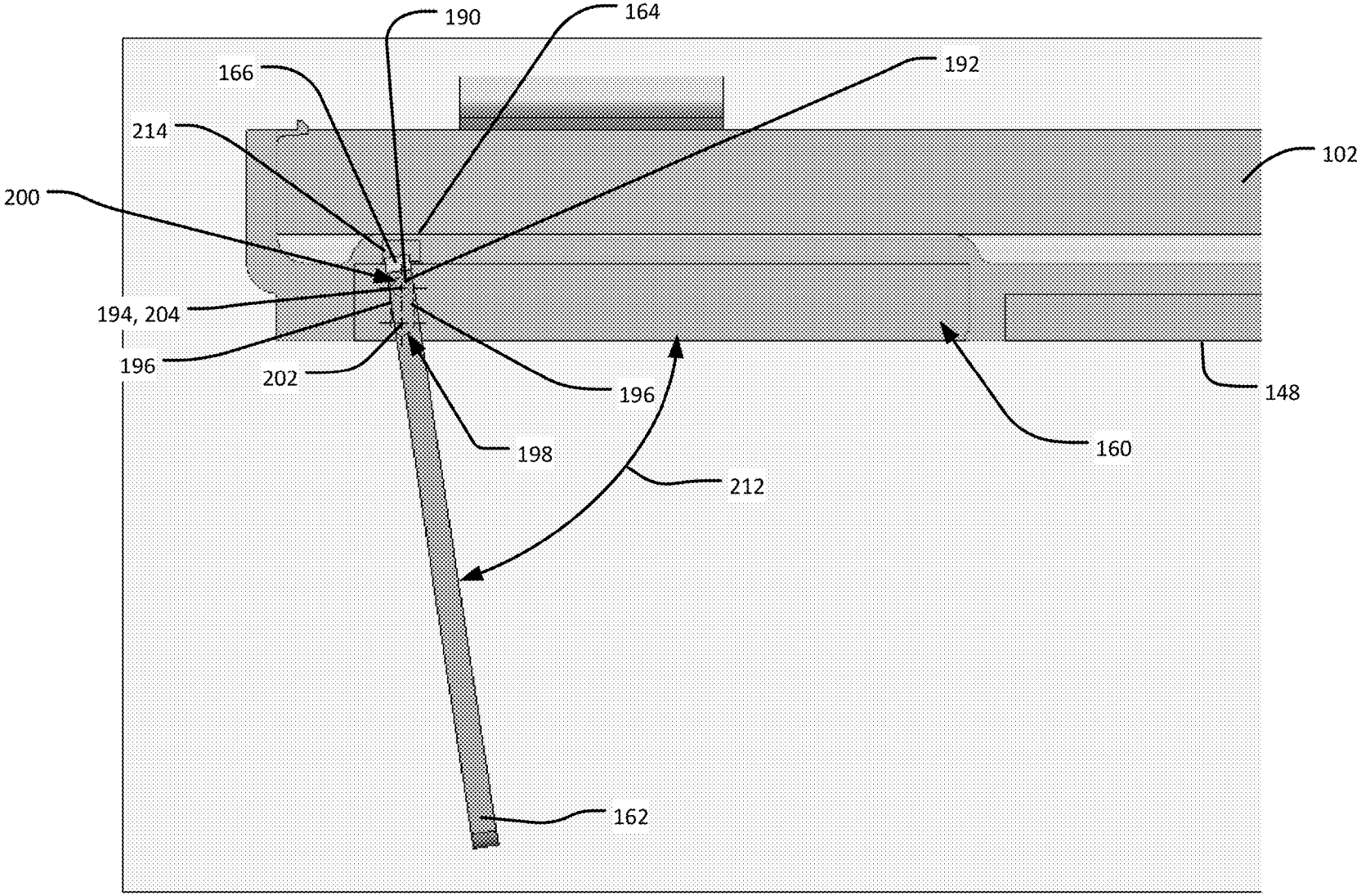
FIG. 12 is partial section view of the crate of FIG. 1 showing the adjustable support leg in a second extended configuration.

Thus, as shown the illustrated embodiment, the leg pins 190 can be selectively engaged with (i.e., retained within) each of the first pivot sections 198 in the stored configuration (see FIG. 10) and in each of the second pivot sections 200 in the extended configuration (see FIGS. 11 and 12). Put another way, the pivot slots 192, and more specifically, the projections 196, are sized and shaped to retain the leg pins 190 within a desired pivot section (e.g., the first pivot section 198 or the second pivot section 200), while also allowing a user to apply a force to the support leg 162 to move (e.g., snappably move) the leg pins 190 between the first pivot section 198 and the second pivot section 200. In this way, the pivot slots 192 can allow the leg pins 190, and therefore the support leg 162, to translate vertically within the pivot slots 192 to move between the first and second pivot sections 198, 200. In other embodiments, other shapes and configurations of pivot slots and/or projections are possible. For example, a pivot slot may only include one pivot section or more than two pivot sections, with the latter having additional projections disposed between adjacent pivot sections.

Pivot slots can be further configured to allow a support leg to rotate relative to a base panel. For example, with continued reference to FIG. 9, each the pivot slots 192 can be aligned with one another on opposing sides of the bottom recess 160 of the base panel 102 so that the first pivot sections 198 define and share a first pivot axis 202, and so that the second pivot sections 200 define and share a second pivot axis 204. Furthermore, the pivot slots 192 are sized and shaped to allow the leg pins 190 to rotate within the respective first and second pivot sections 198, 200. More specifically, the leg pins 190 can be received within each of the first pivot sections 198 and each of the second pivot sections 200 so that the support leg axis 194 can be coincident with and rotate about each of the first pivot axis 202 and the second pivot axis 204, respectively. In some cases, the pivot slots 192 may also permit the leg pins 190 to translate (i.e., move perpendicularly to one or both of the first pivot axis 202 and the second pivot axis 204) within the respective first and second pivot sections 198, 200, for example, to move perpendicularly with respect to the first and second pivot axes 202, 204. Such translation may help in locking the support leg 162 at the desired angle 176 relative to the base panel 102.

Turning now to FIG. 10, the support leg 162 is shown being retained within the bottom recess 160 of the base panel 102 in the stored configuration. In the stored configuration, each of the leg pins 190 can be positioned within a respective first pivot sections 198 of the pivot slots 192 so that the support leg axis 194 is aligned with the first pivot axis 202 of the first pivot sections 198. With the leg pins 190 in the respective first pivot sections 198, the support leg 162 can be rotated to be parallel (i.e., horizontal) with the bottom surface 148 of the base panel 102. Once rotated, the support leg 162 can be retained in the bottom recess 160 by the combination of the leg pins 190 being received in the pivot slots 192 and a locking lip 206 that protrudes into the bottom recess 160. More specifically, the leg pins 190 are retained within the first pivot sections 198 to prevent the first side member 166 from moving downward and the lip 206 extends inwardly toward the bottom recess 160 to engage with and prevent the second side member 168 from moving downward. In this way, the support leg 162 is prevented from rotating about the support leg axis 194 and cannot extend beyond the bottom surface 148 of the base panel 102. Such a configuration may be preferable when the crate 100 is being set on a horizontal surface or being carried by a user.

Turning now to FIGS. 11 and 12, the support leg 162 is shown being retained in the extended configuration, wherein at least a portion of the of the support leg 162 is positioned beyond (i.e., lower than) the bottom surface 148 of the base panel 102. The portion of each of the support leg 162 that extends beyond the bottom surface 148 of the base panel 102 will vary depending on the angle 176 of the support leg 162 relative to the base panel 102. To move the support leg 162 into the extended configuration, a user can apply a force to the support leg 162 to move the leg pins 190 past the projections 196 (i.e., perpendicularly between the first pivot axis 202 and the second pivot axis 204) into to the second pivot sections 200. To move the support leg 162 between the pivot sections 198, 200, the force applied by the user must be greater than the opposing force provided by the projections 196. With the leg pins 190 in the respective second pivot sections 200, the support leg 162 can then be rotated about the support leg axis 194 to move the second side member 168 past the locking lip 206 and beyond the bottom surface 148 of the base panel 102.

In some embodiments, a support leg can be secured at a desired angle relative to the base panel in the extended configuration. In the present embodiment, the support leg 162 can be secured at a desired angle by a user by first positioning the support leg 162 at approximately the desired angle (e.g., within 10 degrees of the desired angle). The user can then simultaneously place the crate 100 onto a support surface (e.g., the seat surface 182) so that the weight of the crate 100 and any items contained within cause the support leg 162 to engage at least partially with the secondary recess 164. In some embodiments, the angle 176 at which the support leg 162 extends from the base panel 102 may be selectable by a user so that base panel 102 is supported in a horizontal position. For example, the angle 176 may range between 0 degrees and 100 degrees. Alternatively, or additionally, the support leg 162 may be rotatable between one or more discrete angles, for example, 25 degrees, 30 degrees, and/or 45 degrees. It is appreciated that the specific angle or angles can vary depending on the relative sizes and positions of the support leg 162, the leg pins 190, the pivot slots 192, and the secondary recess 164.

In the present embodiment, the support leg 162 is configured to be positioned at two discrete angles relative to the base panel 102. More specifically, with specific reference to FIG. 11, the support leg 162 can be secured at a first angle 208, wherein the first side member 166 engages with an edge 210 of the secondary recess 164 (e.g., where the secondary recess 164 adjoins the bottom recess 160). As illustrated, the edge 210 can be chamfered so that the contact between the edge 210 and the first side member 166, in combination with the weight of the crate 100 acting downward to compress the support leg 162 between the base panel 102 and a support surface, can prevent the support leg 162 from rotating about the support leg axis 194. Accordingly, the support leg 162 can be secured in the extended configuration at the first angle 208, which can range between 35 degrees and 55 degrees, and more specifically, approximately 45 degrees. In other embodiments, the support leg 162 may further include one or more locating features, for example, a groove or notch formed in the first side member, which can receive the edge 210 to secure the support leg 162 at the first angle 208.

Alternatively, with specific reference to FIG. 12, if the support surface has a greater slope, the support leg 162 can be secured at a second angle 212, wherein the first side member 166 engages with an inner surface 214 of the secondary recess 164. The contact between the inner surface 214 of the secondary recess 164 and the first side member 166, in combination with the weight of the crate 100 acting downward to compress the support leg 162 between the base panel 102 and a support surface, can prevent the support leg 162 from rotating about the support leg axis 194. Accordingly, the support leg 162 can be secured in the extended configuration at the second angle 212, which can range between 80 degrees and 100 degrees, and more specifically, between 85 degrees and 95 degrees. In other embodiments, the support leg 162 may include a locating feature, for example, a chamfer formed on the first side member, which can engage the inner surface 214 of the secondary recess 164 to secure the support leg 162 at the second angle 212.

Figure 13:
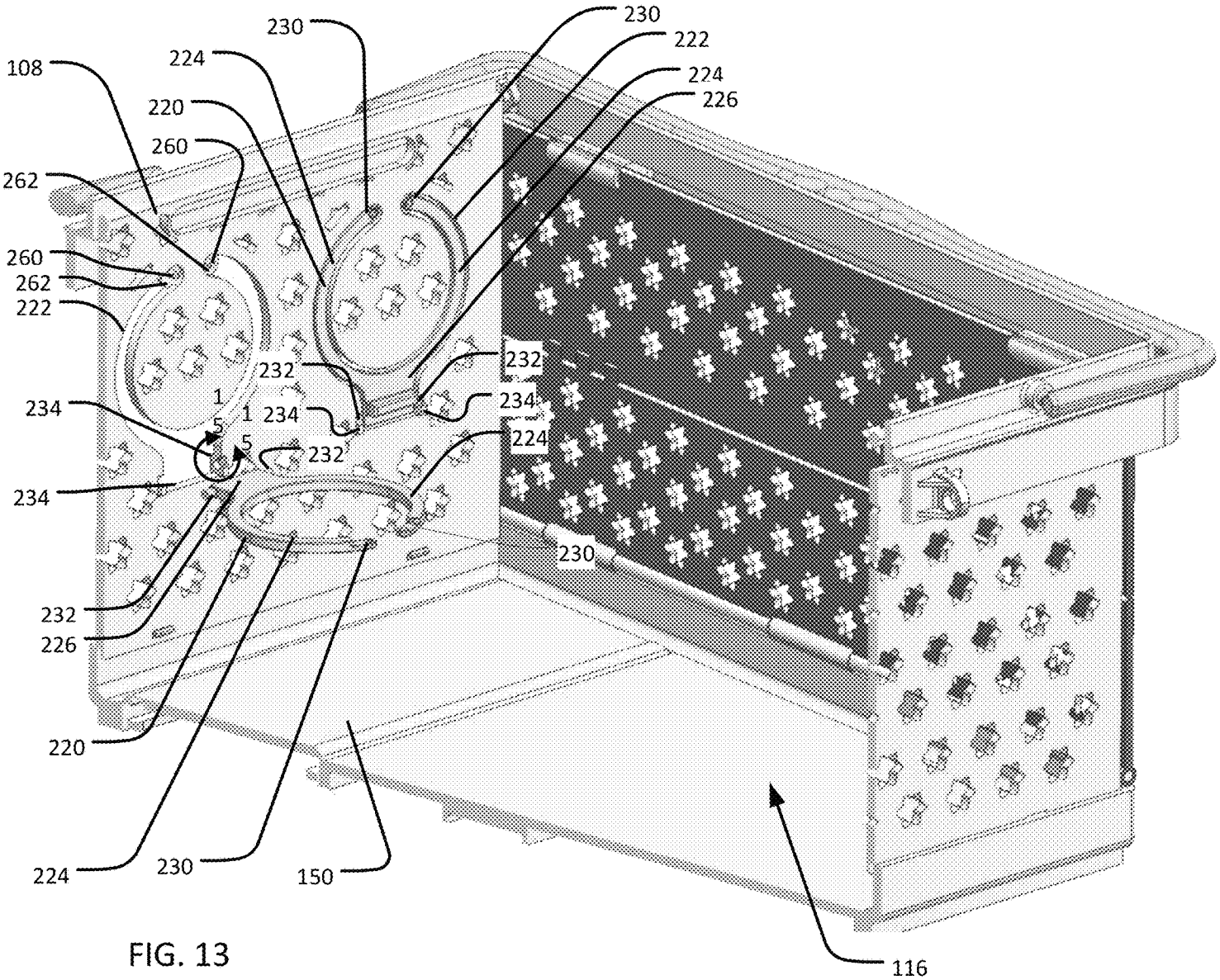
FIG. 13 is partial section view of the crate of FIG. 1 showing storable cup holders in a stored configuration and an extend configuration.
Figure 14:
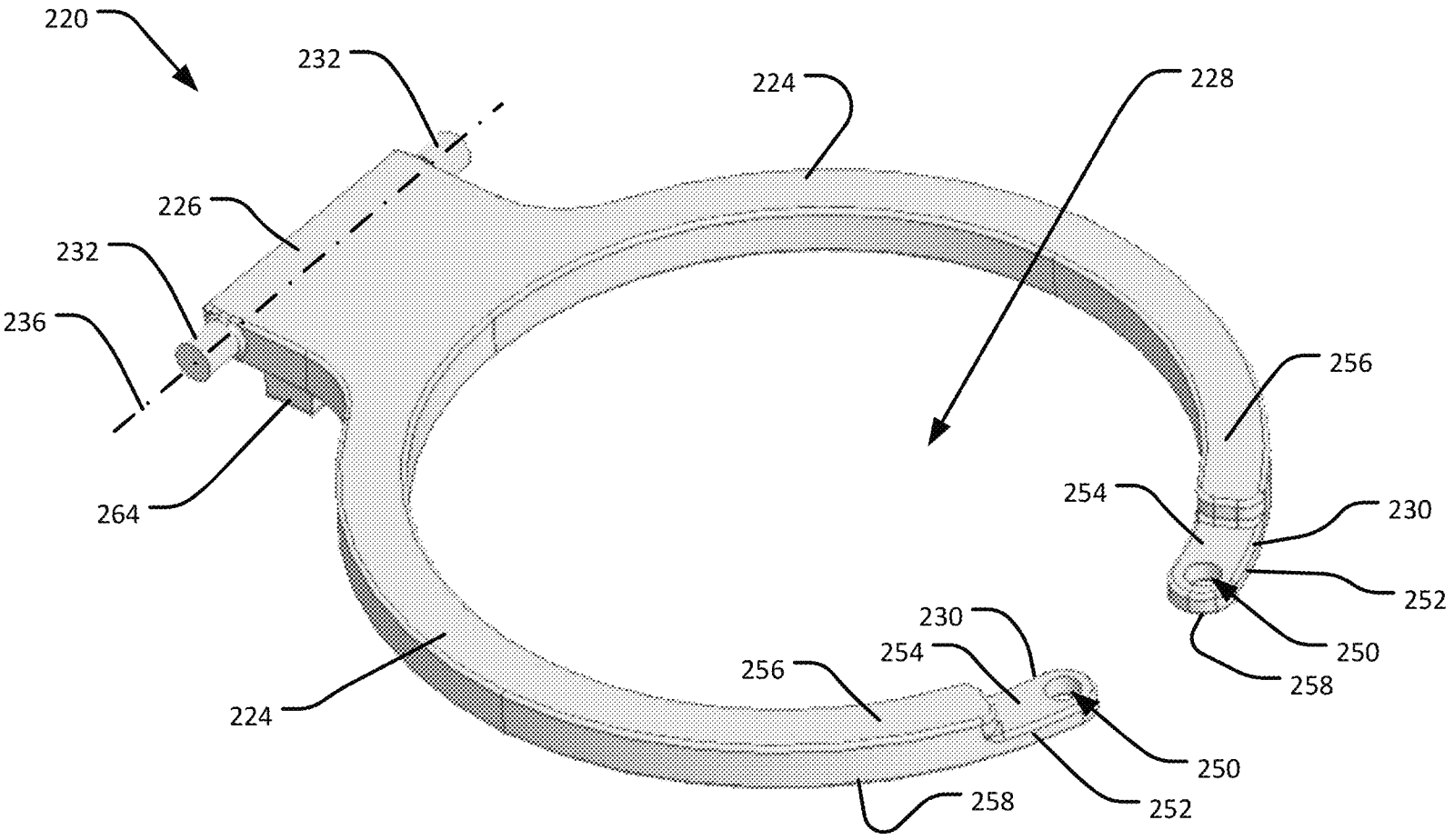
FIG. 14 is perspective view of one of the storable cup holders of FIG. 13.

Turning now to FIGS. 13 and 14, one or more panels (e.g., end panels or side panels) can include one or more cup holders that are configured to allow a cup to be inserted into the cup holder, thereby preventing the cup from tipping over and spilling. As illustrated, the first end panel 108 can include two cup holders 220, each of which can be received in a correspondingly-shaped cup holder opening 222 in the first end panel 108. As illustrated, each of the cup holders 220 can be configured as a substantially planar member that includes a pair of opposing curved arms 224 extending circumferentially from a cup holder base 226, although other configurations are possible (e.g., a basket-shaped cup holder). Together, the cup holder arms 224 and the cup holder base 226 can define a central orifice 228 (i.e., an opening) that can be configured to receive a cup or other food item (not shown).

In some embodiments, cup holders can be configured to support (i.e., retain) a variety of cup sizes and shapes. In particular, in the present embodiment, the cup holder arms 224 have free (i.e., unconnected) distal ends 230, which allows the cup holder arms 224 to flex radially to accept cups that may have a larger diameter than the central orifice 228. For example, a cup having a diameter that is larger than the diameter of the central orifice 228 may contact the cup holder arms 224 at least partially along an inner circumference of the central orifice 228. In turn, the cup can exert a force that acts on the cup holder arms 224 and causes the cup holder arms 224 to extend radially outward, thereby increasing the diameter of the central orifice 228 and allowing the cup to fit. As shown, the cup holders 220 are the same size, however, other size cup holders may also be used to accommodate a larger variety of cups with varying sizes and/or shapes. Similarly, the cup holders 220 are illustrated as being disposed at approximately the same height relative to the base panel 102, but they may alternatively be positioned at different heights to accommodate different sizes cups.

In some embodiments, cup holders can be moved by a user between a stored configuration and an extended configuration to increase the available space in the interior cavity when the cup holders are not in use. In that regard, the cup holders 220 can be configured as foldable or storable cup holders that are rotatably coupled to the first end panel 108. That is, each cup holder 220 can be independently rotated between a stored configuration (see cup holder 220 pictured right in FIG. 13), wherein the cup holder 220 is disposed within the respective cup holder opening 222 so that the cup holder arms 224 of the cup holder 220 are coplanar with the first end panel 108, and an extended configuration (see cup holder 220 pictured left in FIG. 13), wherein the cup holder 220 is rotated downward so that the cup holder arms 224 extend away from the first end panel 108 and into the interior cavity 116. In the extended configuration, the cup holder 220 can be substantially parallel (e.g., within 5 degrees of parallel) with the base surface 150 of the base panel 102.

To allow the cup holders 220 to rotate between the stored configuration and the extended configuration, each cup holder 220 can include a pair of cup holder pins 232, which can be configured to be snappably received in a corresponding retainer 234 formed in the first end panel 108. The cup holder pins 232 are configured as cylindrical protrusions that extend outwardly from opposing sides of the cup holder base 226. More specifically, each pair of cup holder pins 232 are aligned with one another to define a cup holder axis 236, about which the cup holder 220 can rotate between the stored configuration and the extended configuration.

Figure 15:
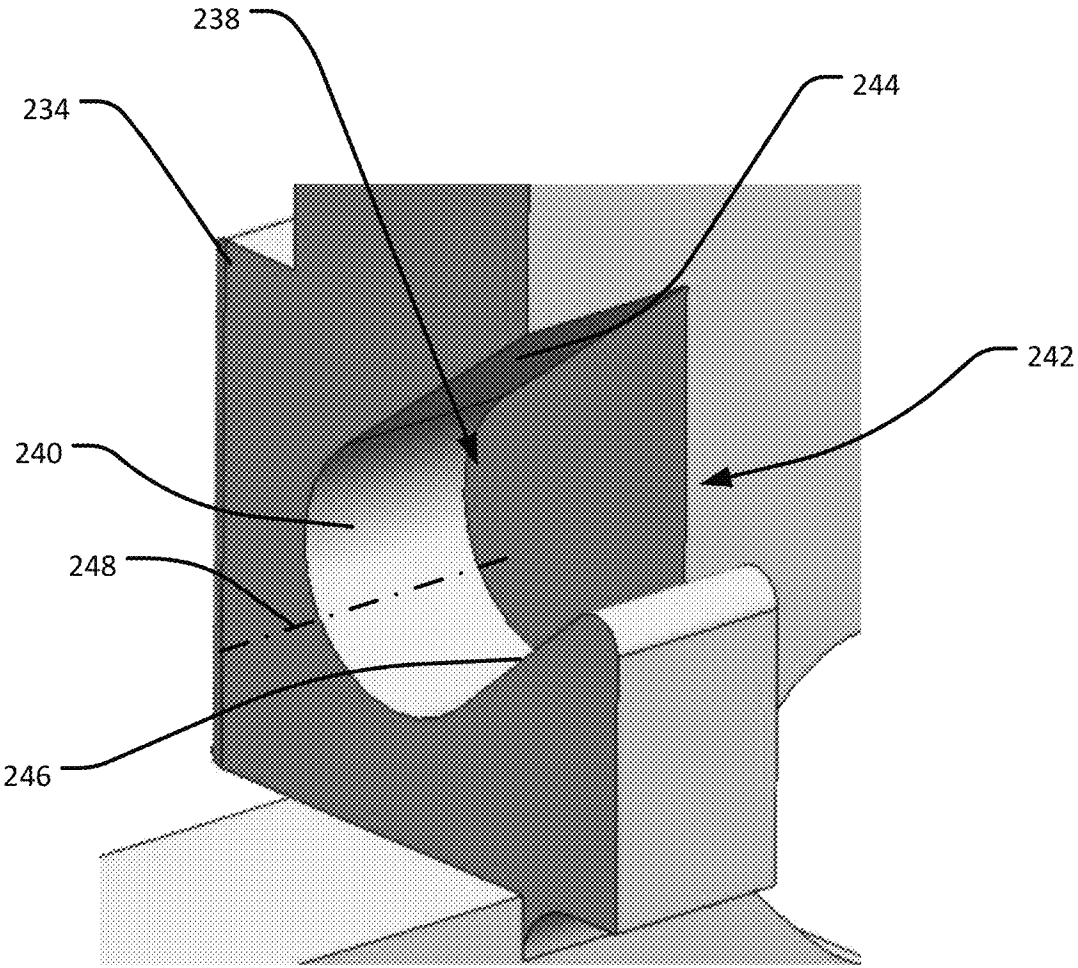
FIG. 15 is a partial perspective view of a retaining bracket of the crate of FIG. 13, taken about the line 15-15.

With additional reference to FIG. 15, each of the retainers 234 can be configured as a block that is integrally formed with the first end panel 108. Each retainer 234 defines a retainer slot 238 that extends between a closed, rounded end 240 and an open end 242. The retainer slot 238 further defines a first slot side 244 opposite a second slot side 246, which are angled to one another so that a width of the retainer slot 238 (i.e., a distance between the slot sides 244, 246) is smaller at the open end 242 than at the closed end 240. More specifically, the width of the retainer slot 238 at the open end 242 is slightly smaller than a diameter of the corresponding cup holder pin 232 and the width of the slot 238 at the closed end 240 is larger than the diameter of the corresponding cup holder pin 232. In this way, the slot 238 can snappably receive and retain the corresponding cup holder pin 232, while still allowing the corresponding cup holder 220 to rotate once it is received in the slot 238 near the closed end 240. In some cases, the closed end 240 of the slot 238 can define a retainer axis 248 that is aligned with the corresponding cup holder axis 236 when the corresponding cup holder 220 is received within the slot 238. In other embodiments, the rotation of the cup holders 220 relative to the first end panel 108 can be facilitated by other structures as known in the art, for example, a hinge or pins that are rotatably received in holes.

In some embodiments, it may be preferable to limit the rotation of the cup holders 220 between the stored configuration and the extended configuration. For example, to limit the rotation of the cup holders 220 and to retain the cup holders 220 in the stored configuration, each cup holder 220 can further include a locking orifice 250 formed at the respective distal end 230 of each of the cup holder arms 224. Each locking orifice 250 is disposed within a corresponding stepped portion 252 of the cup holder arm 224, which is thinner than the remaining portion of the cup holder arm 224. That is, the stepped portion 252 defines an intermediary surface 254 and has a thickness that is less than a thickness of the cup holder arms 224, the respective thicknesses being taken along a direction extend between a first, upper or outer surface 256 of the cup holder 220 and a second, lower or inner surface 258 of the cup holder 220. In this case, the ratio of the thickness of the stepped portion 252 to the thickness of the cup holder arm 224 is approximately 0.5, but the ratio may also be greater than or less than 0.5.

Each of the locking orifices 250 can be configured to receive a corresponding locking pin 260 that can protrude perpendicularly from an inner flange 262 within the cup holder opening 222 and towards the interior cavity 116 of the crate 100. Accordingly, when the cup holder 220 is rotated into the stored configuration, the locking orifices 250 snappably and/or frictionally receive the locking pins 260 to prevent the cup holder 220 from rotating downward to the extended configuration, and the cup holder 220 is prevented from rotating in the opposite direction (i.e., away from the interior cavity 116 of the crate 100) by the intermediate surface 254 contacting the inner flange 262. Thus, the cup holder 220 is retained within the cup holder opening 222 so that it is coplanar with the first end panel 108. The locking pins 260 and the inner flanges 262 can be integrally formed with the first end panel 108.

It may also be beneficial to limit the rotation of a cup holder so that is substantially parallel with a base surface of the base panel. For example, as illustrated, each cup holder 220 can include a stop block 264 that protrudes from the inner surface 258 of the cup holder 220, which can be configured to limit the downward rotation of the cup holder 220 so that the cup holder 220 is substantially parallel with the base panel 102 in the extended configuration. That is, the stop block 264 can be sized and positioned on the inner surface 258 so that the stop block 264 can engage with the first end panel 108 to limit the rotation of the cup holder 220. In the present embodiment, the stop block 264 is configured as a rectangular protrusion that is positioned on and extends outwardly from the inner surface 258 of the cup holder base 226. More specifically, the stop block 264 is positioned between the cup holder pins 232 and the cup holder arms 224. In other embodiments, the cup holders 220 may include more than one stop block and any included stop blocks may have a different size or shape. Accordingly, any included stop blocks may be positioned elsewhere on the inner surface 258 of the cup holder 220 to limit the rotation of the cup holder 220 and ensure it is substantially parallel with the base surface 150.

In other embodiments, other means as known in the art may be used to limit (i.e., control) the rotation of the cup holders. For example, any cup holders and a first end panel may include a variety of bumps and/or corresponding recess, which can act as detents to limit the rotation of the cup holders and/or hold the cup holders in a desired position.

Figure 16:
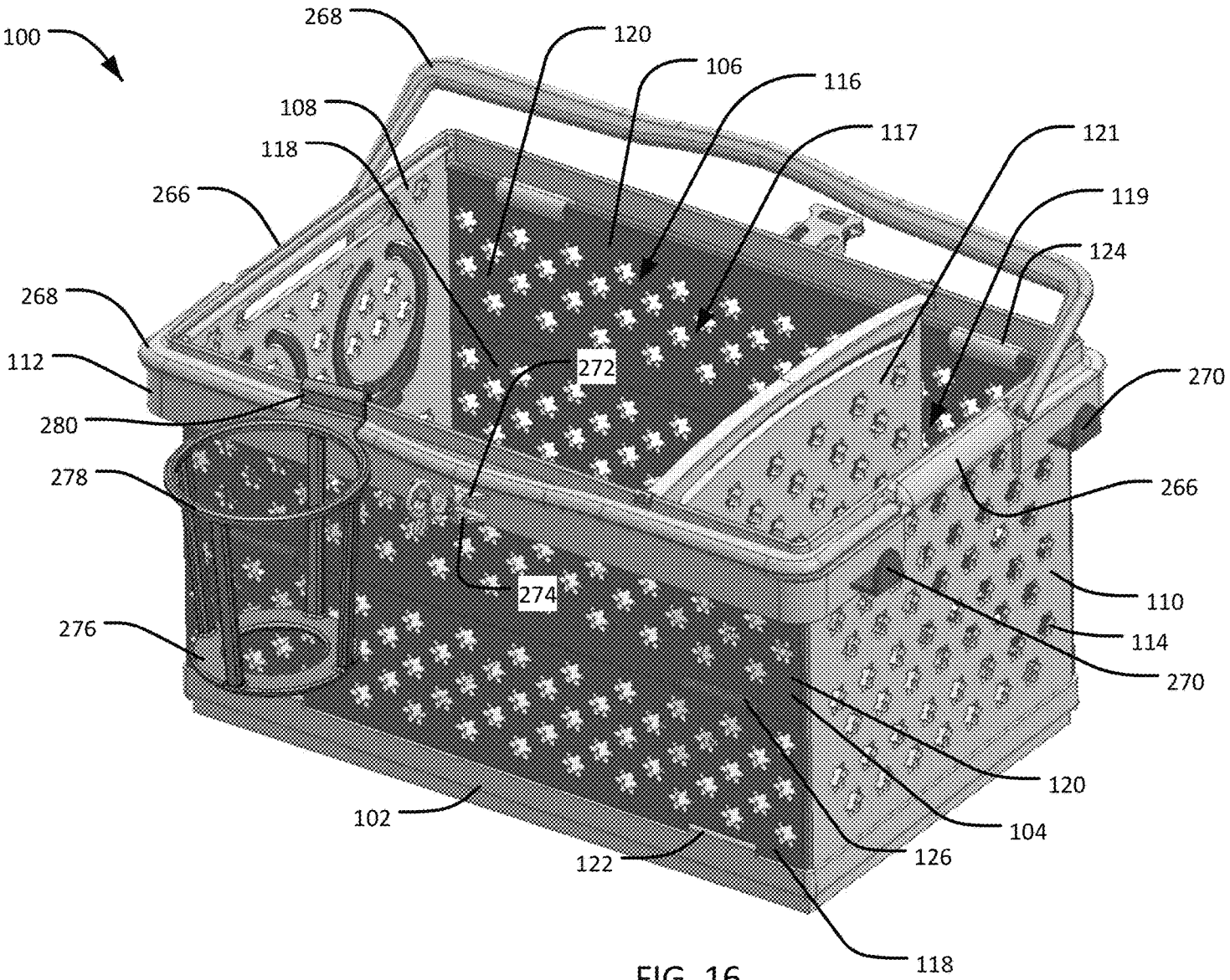
FIG. 16 is a perspective view of the crate of FIG. 1 with a removable cup-holder.

Turning now to FIG. 16, a top ring may include structures to allow a crate to be carried by a user. For example, in the illustrated embodiment, the top ring 112 includes rounded handle portions 266 (e.g., fixed handles) formed in the top ring 112 near each of the end panels 108, 110. In other embodiments, the top ring 112 may include more or fewer handle portions 266, or none at all. Relatedly, the handle portions 266 may be located anywhere along the perimeter of the top ring 112, although is it preferable that any handle portions are disposed opposite one another.

Additionally or alternatively, the top ring 112 can include a pair of rotatable handles 268 that are configured to couple with and rotate relative to the top ring 112. As illustrated, the rotatable handles 268 extend between opposing sides of the top ring 112 that are adjacent the end panels 108, 110, respectively. Additionally, the rotatable handles 268 can be removably coupled to the top ring 112, but they may alternatively be permanently coupled to the top ring 112. In other embodiments, the rotatable handles 268 may be coupled to different portions (i.e., sides) of the top ring 112. For example, the rotatable handles 268 may be rotated 90 degrees to couple with the sides of the top ring 112 adjacent the side panels 104, 106. In yet other embodiments, the top ring 112 may only be provided with a single rotatable handle 268, or none at all.

Additionally, a top ring may include additional structures to allow items to be attached to the outside of a crate. For example, the top ring 112 can optionally include one or more hooks 270 to allow a user to hang items from the top ring 112, for example, a bag. As shown, the top ring 112 includes two hooks 270 that are integrally formed with the top ring 112. The hooks 270 extend outwardly from the top ring 112 (i.e., away from the interior cavity 116) to allow a user to hang items on an exterior of the crate 100 and/or to allow a user to carry items that may not otherwise fit within the interior cavity 116, thereby effectively increasing the capacity of the crate 100. In other embodiments, the hooks 270 may be disposed anywhere along the top ring 112. For example, some hooks 270 may be positioned to extend into the interior cavity 116. In this way, the hooks 270 can, for example, keep items off the base surface 150 or provide a securing location for an item to help prevent the item from tipping or spilling within the interior cavity 116.

Furthermore, a top ring can include one or more attachment brackets. As illustrated, the top ring 112 includes two attachment brackets 272. The attachment brackets 272 can be integrally formed with the top ring 112 and extend outwardly therefrom (i.e., away from the interior cavity 116). Each attachment bracket 272 defines an opening 274 configured to allow a user to attach, for example, a strap, clip, or other items to the attachment bracket 272. In some cases, the attachment brackets 272 can be used to attach items to the top of crate 100 (i.e., via the top ring 112). For example, a user could connect each end of an adjustable strap to one of the attachment brackets 272, which could then be used to secure, for example, a pizza box or other large item onto the top ring 112 of the crate 100 (e.g., to be above the interior cavity 116).

With continued reference to FIG. 16, a crate can further include one or more detachable cup holders. As illustrated, the crate 100 includes a detachable cup holder 276 having a cup-receiving portion 278 and a connector portion 280 that can be configured to detachably couple with the crate 100. The cup-receiving portion 278 is shown being configured as a basket that can receive and support a cup, but other types of cup-receiving portions as known in the art may also be used. The connector portion 280 is shown being configured as a hook that can be configured to engage with the top ring 112 of the crate 100, thereby securing the detachable cup holder 220 to crate 100. Other types of connection portions 280 as known in the art may also be used, and the detachable cup holder 220 can also be configured to couple with other portions of the crate 100, for example, the attachment bracket 272, or a side or end panel 104-110. Additionally, in other embodiments, more than one detachable cup holder 220.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

I claim:

1. A crate comprising:

a base panel defining a bottom surface of the crate, the base panel defining a first pivot slot and a second pivot slot, each of the first pivot slot and the second pivot slot defining a first pivot section and a second pivot section that are separated from one another by a pair of opposing projections;

a plurality of side panels extending upwardly from the base panel to define an interior cavity of the crate; and an adjustable leg moveably coupled to the base panel, the adjustable leg being configured to move relative the base panel between a stored configuration, in which the adjustable leg is substantially parallel with the base panel, and an extended configuration, in which the adjustable leg extends away from the plurality of side panels, the adjustable leg including a first leg pin opposite a second leg pin, each of the first leg pin and the second leg pin configured to be received within a respective one of the first pivot slot and the second pivot slot so that each of the first leg pin and the second leg pin are configured to be rotatably received in the first pivot section and the second pivot section of the respective one of first pivot slot and the second pivot slot, and to be snappably moveable between the first pivot section and the second pivot section of the respective one of the first pivot slot and the second pivot slot.

2. The crate of claim 1, wherein, in the stored configuration, the first leg pin is received in the first pivot section of the first pivot slot and the second leg pin is received in the first pivot section of the second pivot slot; and wherein, in the extended configuration, the first leg pin is received in the second pivot section of the first pivot slot and the second leg pin is received in the second pivot section of the second pivot slot.

3. The crate of claim 1, wherein the base panel defines a bottom recess configured to receive the adjustable leg, the adjustable leg being fully received within the bottom recess in the stored configuration and extending out of and away from the bottom recess in the extended configuration.

4. The crate of claim 3, wherein the bottom recess includes a locking lip that is configured to retain the adjustable leg in the stored configuration.

5. The crate of claim 1, wherein the adjustable leg is configured to rotate relative to the base panel to extend away from the base panel in the extended configuration.

6. The crate of claim 5, wherein, in the extended configuration, the adjustable leg is configured to extend at a non-zero angle relative to a bottom surface of the base panel.

7. The crate of claim 6, wherein the adjustable leg is configured to extend at one or more discrete angles relative to the bottom surface of the base panel.

8. The crate of claim 1, wherein the adjustable leg is configured to raise a first end of the crate so that the base panel is horizontal when the crate is placed on a sloped support surface.

9. The crate of claim 1, wherein the crate further comprises a top ring and the plurality of side panels includes a first side panel opposite a second side panel and a first end panel opposite a second end panel;

wherein the first side panel includes a first sub-panel rotatably coupled to a second sub-panel, the first sub-panel being rotatably coupled to the base panel and the second sub-panel being rotatably coupled to the top ring;

wherein the second side panel includes a third sub-panel rotatably coupled to a fourth sub-panel, the third sub-panel being rotatably coupled to the base panel and the fourth sub-panel being rotatably coupled to the top ring, wherein the first end panel is rotatably coupled to the top ring and configured to selectively engage with the base panel; and wherein the second end panel is rotatably coupled to the top ring and configured to selectively engage with the base panel.

10. A crate comprising:

a base panel defining a bottom surface of the crate, and the base panel further defining a first pivot slot and a second pivot slot, each of the first pivot slot and the second pivot slot defining a first pivot section and a second pivot section that are separated from one another by a pair of opposing projections;

a top ring disposed above the base panel;

a first side panel including a first sub-panel rotatably coupled to a second sub-panel, the first sub-panel being rotatably coupled to the base and the second sub-panel being rotatably coupled to the top ring;

a second side panel including a third sub-panel rotatably coupled to a fourth sub-panel, the third sub-panel rotatably coupled to the base and the fourth sub-panel rotatably coupled to the top ring;

a first end panel rotatably coupled to the top ring and configured to selectively engage with the base; and a second end panel rotatably coupled to the top ring and configured to selectively engage with the base; and an adjustable leg moveably coupled to the base panel, the adjustable leg being configured to rotate relative the base panel between a stored configuration, in which the adjustable leg is substantially parallel with the base panel, and an extended configuration, in which the adjustable leg extends away from the base panel at a non-zero angle relative to the bottom surface, the adjustable leg including a first leg pin extending outwardly from a side of the adjustable leg and configured to be received within a first pivot slot, and a second leg pin extending outwardly from an opposing side of the adjustable leg and configured to be received within a second pivot slot.

11. The crate of claim 10, wherein the base panel defines a bottom recess that is open along the bottom surface, the bottom recess being configured to fully receive the adjustable leg in the stored configuration and to allow the adjustable leg to rotate relative to the base panel to extend out of the bottom recess in the extended configuration.

12. The crate of claim 11, wherein the first pivot slot is defined within the bottom recess, and the second pivot slot is defined within the bottom recess.

13. The crate of claim 12, wherein, in the stored configuration, the first leg pin is received in the first pivot section of the first pivot slot and the second leg pin is received in the first pivot section of the second pivot slot; and wherein, in the extended configuration, the first leg pin is received in the second pivot section of the first pivot slot and the second leg pin is received in the second pivot section of the second pivot slot.

14. The crate of claim 13, wherein the pair of opposing projections of the first pivot slot are configured to selectively retain the first leg pin in each of the first and second pivot sections such that the first leg pin is snappably moveable between the first pivot section and the second pivot section of the first pivot slot; and wherein the pair of opposing projections of the second pivot slot are configured to selectively retain the second leg pin in each of the first and second pivot sections such that the second leg pin is snappably moveable between the first pivot section and the second pivot section of the second pivot slot.

15. The crate of claim 10, wherein the non-zero angle between the adjustable leg and the bottom surface is selectable by a user.

16. A base panel for a crate having a plurality of side panels extending upwardly from the base panel, the base panel comprising:

a first pivot slot and a second pivot slot, each of the first pivot slot and the second pivot slot defining a first pivot section and a second pivot section that are separated from one another by a pair of opposing projections;

a bottom recess that opens along a bottom surface, the bottom surface being configured to contact a support surface; and an adjustable leg, wherein the adjustable leg includes a first leg pin opposite a second leg pin, each of the first leg pin and the second leg pin configured to be received within a respective one of the first pivot slot and the second pivot slot so that each of the first leg pin and the second leg pin are configured to be rotatably received in the first pivot section and the second pivot section of the respective one of first pivot slot and the second pivot slot, and to be snappably moveable between the first pivot section and the second pivot section of the respective one of the first pivot slot and the second pivot slot moveably coupled to the base panel within the bottom recess, the adjustable leg being configured to move relative the base panel between a stored configuration, in which the adjustable leg is fully received within the bottom recess, and an extended configuration, in which the adjustable leg extends out of the bottom recess.

17. The crate of claim 16, wherein the movement of the adjustable leg between the stored configuration and the extended configuration includes rotational motion.

18. The crate of claim 16, wherein, in the extended position, the adjustable leg raises an end of the base panel so that the base panel is horizontal when placed on a sloped support surface.

* * * * *